US010605529B2

(12) United States Patent
Wieland et al.

(10) Patent No.: US 10,605,529 B2
(45) **Date of Patent: *Mar. 31, 2020**

(54) SYSTEM HAVING A PROCESS CHAMBER FOR WORKPIECES

(71) Applicant: Duerr Systems AG, Bietigheim-Bissingen (DE)

(72) Inventors: Dietmar Wieland, Waiblingen (DE); Oliver Iglauer, Stuttgart (DE); Christof Knuesel, Munich (DE); Marius Winkler, Pleidelsheim (DE)

(73) Assignee: Duerr Systems AG, Bietigheim-Bissingen (DE)

( * ) Notice: Subject to any disclaimer, the term of this patent is extended or adjusted under 35 U.S.C. 154(b) by 59 days.

This patent is subject to a terminal disclaimer.

(21) Appl. No.: 15/960,283

(22) Filed: Apr. 23, 2018

(65) Prior Publication Data

US 2018/0238622 A1 Aug. 23, 2018

Related U.S. Application Data

(63) Continuation-in-part of application No. 15/230,078, filed on Aug. 5, 2016, now Pat. No. 9,970,706, which (Continued)

(30) Foreign Application Priority Data

May 2, 2012 (DE) ..... 10 2012 207 312

(51) Int. Cl.
*F26B 15/14* (2006.01)
*F26B 21/00* (2006.01)

(Continued)

(52) U.S. Cl.
CPC ..... *F26B 15/14* (2013.01); *F26B 21/004* (2013.01); *F26B 21/04* (2013.01); *F26B 21/10* (2013.01);

(Continued)

(58) Field of Classification Search
CPC ..... F26B 15/14; F26B 21/004; F26B 21/04; F26B 21/10; F26B 25/008; F26B 23/022; F26B 2210/12

(Continued)

(56) References Cited

U.S. PATENT DOCUMENTS 1,606,442 A 11/1926 Nichols
RE18,645 E 11/1932 Whitmore (Continued)

FOREIGN PATENT DOCUMENTS

DE 1 095 497 B 12/1960
DE 10 2012 207 312 A1 11/2013

(Continued)

OTHER PUBLICATIONS

International Search Report dated Sep. 3, 2013 of international application PCT/EP2013/058817 on which this application is based.

(Continued)

*Primary Examiner* — Stephen M Gravini
(74) *Attorney, Agent, or Firm* — Walter Ottesen, P.A.

(57) ABSTRACT

An installation has a process chamber defining an inner space having a tunnel-like form defining a receiving region for workpieces. The process chamber has a portal for the supply or discharge of workpieces and has a device for introducing gaseous fluid into the inner space. The device has a nozzle for producing a fluid stream curtain between the portal and the receiving region. A device supplies fresh air introduced into the receiving region at a side of the fluid stream curtain facing away from the portal. The installation has a pivotable guide contour projecting into the inner space and the nozzle or aperture is in the form of a slot which supplies the gaseous fluid to the inner space via the ceiling (Continued)

with a flow direction oblique relative to the floor. The gaseous fluid supplied via the nozzle to the inner space is guided on the guide contour.

31 Claims, 19 Drawing Sheets

Related U.S. Application Data is a continuation-in-part of application No. 14/398,721, filed as application No. PCT/EP2013/058817 on Apr. 26, 2013, now Pat. No. 9,423,179.

(51) Int. Cl.

| | |
|---|---|
| ***F26B 21/04*** | (2006.01) |
| ***F26B 25/00*** | (2006.01) |
| ***F26B 21/10*** | (2006.01) |
| ***F26B 23/02*** | (2006.01) |

(52) U.S. Cl.
CPC ..... *F26B 25/008* (2013.01); *F26B 23/022* (2013.01); *F26B 2210/12* (2013.01)

(58) Field of Classification Search
USPC ..... 34/417
See application file for complete search history.

(56) References Cited

U.S. PATENT DOCUMENTS

| | | | | |
|---|---|---|---|---|
| 3,443,878 | A | 5/1969 | Weber et al. | |
| 3,947,235 | A | 3/1976 | Bornert | |
| 4,020,564 | A | 5/1977 | Bayliss | |
| 4,338,364 | A | 7/1982 | Kennon et al. | |
| 4,561,193 | A * | 12/1985 | Burger | B60S 3/002 15/316.1 |
| 5,568,692 | A | 10/1996 | Crompton et al. | |
| 5,657,555 | A | 8/1997 | Milojevic et al. | |
| 5,956,859 | A | 9/1999 | Matsumoto et al. | |
| 6,065,225 | A | 5/2000 | Herre | |
| 6,067,725 | A | 5/2000 | Moser | |
| 7,600,329 | B2 | 10/2009 | Ortlieb et al. | |
| 7,658,017 | B1 | 2/2010 | Laviolette et al. | |
| 8,196,310 | B2 | 6/2012 | McMahon et al. | |
| 8,429,831 | B2 | 4/2013 | Gillick et al. | |
| 8,658,240 | B2 | 2/2014 | Fritz et al. | |
| 8,756,827 | B1 | 6/2014 | Calabro et al. | |
| 8,997,374 | B2 | 4/2015 | Sato | |
| 9,096,079 | B2 | 8/2015 | Priebe et al. | |
| 9,296,363 | B2 | 3/2016 | Pihlblad | |
| 9,316,406 | B2 | 4/2016 | Wieland et al. | |
| 9,538,886 | B2 | 1/2017 | Ros Marin | |
| 9,970,706 | B2 * | 5/2018 | Wieland | F26B 25/008 |
| 2011/0262324 | A1 | 10/2011 | Fritz et al. | |
| 2011/0274827 | A1 | 11/2011 | Fritz et al. | |
| 2013/0167395 | A1 | 7/2013 | Bruckner | |
| 2013/0232801 | A1 | 9/2013 | Wieland et al. | |
| 2015/0121720 | A1 | 5/2015 | Wieland et al. | |
| 2016/0348968 | A1 | 12/2016 | Wieland et al. | |
| 2018/0238622 | A1 * | 8/2018 | Wieland | F26B 15/14 |

FOREIGN PATENT DOCUMENTS

| | | | |
|---|---|---|---|
| EP | 2844937 | | 3/2015 |
| EP | 2 358 481 | B1 | 12/2015 |
| GB | 2 123 936 | A | 2/1984 |
| JP | 5330610 | B2 | 10/2013 |
| KR | 10-2014-0009154 | A | 1/2014 |
| WO | 2010/122121 | A2 | 10/2010 |
| WO | 2012/055634 | A1 | 5/2012 |
| WO | 2013/164285 | A1 | 11/2013 |

OTHER PUBLICATIONS

English translation and 2nd Chinese Office action dated Apr. 28, 2016 of corresponding Chinese patent application 201380023073.6.
Yi, Z., et al., "Technology of surface finishing of furniture", Chemical Industry Press, Sep. 2011, pp. 170-174 and partial English translation.
International Preliminary Report on Patentability (Translation) dated Nov. 4, 2014 of international application PCT/EP2013/058817 on which this application is based.

* cited by examiner

SYSTEM HAVING A PROCESS CHAMBER FOR WORKPIECES

CROSS REFERENCE TO RELATED APPLICATIONS

This application is a continuation-in-part application of patent application Ser. No. 15/230,078, filed Aug. 5, 2016, which, in turn, is a continuation-in-part application of patent application Ser. No. 14/398,721, filed Nov. 3, 2014 (now U.S. Pat. No. 9,423,179, issued Aug. 23, 2016), which, in turn, is the national stage of PCT/EP2013/058817, filed Apr. 26, 2013, designating the United States and claiming priority from German patent application no. 10 2012 207 312.4, filed May 2, 2012, the entire contents of which are incorporated herein by reference.

FIELD OF THE INVENTION

The invention relates to an installation having a process chamber which has an inner space having a receiving region for workpieces and which has a portal for the supply or discharge of workpieces and which has a device for the introduction of gaseous fluid into the inner space, which device comprises at least one nozzle or aperture for the production of a fluid stream curtain between the portal and the receiving region for workpieces.

BACKGROUND OF THE INVENTION

An installation of this type is known from DE 24 54 091 A1. The installation has a process chamber with an inlet portal and an outlet portal, in which there is in each case one fluid stream curtain. The fluid stream curtain is in this case composed partially of fresh air, which can pass into the interior of the process chamber.

WO 2010/122121 A1 describes an installation for drying workpieces, which installation has a process chamber for controlling the temperature of workpieces, which process chamber is closed by means of a fluid stream curtain at an inlet portal and at an outlet portal. The process chamber is in this case likewise fed with the fresh air from the fluid stream curtain.

GB 2 123 936 A describes an installation for drying workpieces in a process chamber, which receives fresh air by means of a fluid stream curtain of the inlet portal and outlet portal.

U.S. Pat. No. 1,606,442 A has disclosed an installation for drying vehicle bodies, which installation has a process chamber which is separated from the surroundings by means of a fluid curtain. The vehicle bodies that are dried in the process chamber in the installation are moved through the fluid stream curtain as they exit the installation. To produce the fluid stream curtain, the installation has an aperture or nozzle with a slot-shaped opening which extends over the entire width of the process chamber.

U.S. Pat. No. 3,947,235 describes a process chamber and a method for drying freshly painted vehicle bodies, wherein a fluid stream curtain is produced between portals for the supply and discharge of the motor vehicle bodies into and out of the process chamber and a receiving region for the vehicle bodies in the process chamber.

In production units for painting and coating vehicle bodyworks, drying installations are used for drying vehicle bodyworks which have been freshly painted or coated with corrosion protection. Those installations have a process chamber which is in the form of a drying tunnel and into which hot air is blown. There is a drying zone in the drying tunnel. The drying zone is a receiving region for workpieces in the form of vehicle bodyworks. In order to dry the vehicle bodyworks, they are moved on a conveying device through the drying tunnel. The coat of paint or coating of the vehicle bodyworks to be dried may be impaired by impurities, in particular particles of dust. Furthermore, gaseous fluid and with it heat from the inner space may be discharged through a portal for the supply of workpieces.

SUMMARY OF THE INVENTION

An object of the invention is to provide an installation having a process chamber which has an inner space which has a receiving region for workpieces and which can be opened at least partially, in which installation an efficient thermal separation of that inner space from the environment is possible with simple means and, at the same time, an adequate fresh air supply for the receiving region can be ensured.

The installation has a process chamber which includes: an inner space defining a tunnel-shaped receiving region for workpieces; the receiving region having a ceiling and a floor; a portal for supplying or discharging workpieces; a blowing arrangement for blowing a gaseous fluid into the inner space; the blowing arrangement including at least one slot-shaped nozzle or aperture for generating a fluid flow curtain between the portal and the receiving region for workpieces; a pivotable guide plate having a guide contour formed thereon; and, the slot-shaped nozzle or aperture being arranged to direct the gaseous flow via the ceiling into the inner space along the guide contour in a flow direction inclined with respect to the floor.

The term "fresh air" is intended to be understood to be air which is in particular precompressed, heated and/or cleaned thermally and/or mechanically with a filter and/or dried and the status parameters of which are adjusted according to requirements. Fresh air may also be, for example, prepared exhaust air from a process chamber. Furthermore, fresh air may also be the exhaust gas from a heat engine or internal-combustion engine. With the supply of fresh air into the receiving region of the process chamber, it can be ensured that the solvent content of the air inside the process chamber does not exceed, when workpieces are dried, any threshold values above which drying processes are impaired and above which combustible solvents comprising dyes, paints, adhesives and/or coatings can bring about explosions because an explosion limit has been exceeded.

The invention is based on the notion that at least one air lock of a process chamber in a drying installation performs a dual function: fresh air which is supplied to the air locks and which produces a fresh air curtain can, on the one hand, be used to separate the inner space from the environment in technical flow terms and/or thermally. On the other hand, it is possible with the fresh air of the fresh air curtain for the solvent released during drying processes in the process chamber to be diluted sufficiently in that this fresh air is introduced into the process chamber.

Since the first function is charge-independent and the second function is charge-dependent, the inventors propose that this dual function of the air locks be separated. A volume flow which is directed into the process chamber is intended to be reduced or increased in terms of fluid in accordance with the charge of the process chamber. Fluids which may be considered include in particular fresh air and/or returned exhaust air. If a fresh air stream which is supplied to the process chamber of a drying installation is heated to a drying temperature, the adaptation of the fresh air volume stream to the charge allows a temporary reduction of the fresh air volume flow below its maximum value and consequently a reduction of the energy consumption.

The device preferably contains for the supply of fresh air in the installation at least one line which communicates with the receiving region and which has an opening for drawing in fresh air and which has a throughflow control device. The throughflow control device may comprise, for example, a throttle valve and/or an adjustable fan.

The installation may have in particular a device for agitating gaseous fluid in the receiving region by means of a circulating air line system which communicates with the receiving region and which is guided through a device for temperature control, in particular for heating gaseous fluid from the receiving region. The fresh air supplied to the process chamber can be supplied to the circulating air line system, for example, upstream or also downstream of a heat exchanger in the device for the temperature control. However, it is also possible to supply the fresh air in a line portion of the circulating air line system, by means of which line portion circulating air from the process chamber is directed to the device for temperature control or can be introduced into the process chamber by the circulating air which is temperature-controlled in the device for temperature control.

The installation may also contain a device for the supply of fresh air into the receiving region, which device has at least one line which has an opening for drawing in fresh air and which is connected to the circulating air line system. In this instance, a circulating air fan can be used in a cost-effective manner alternately or simultaneously to convey fresh air. A throughflow control device is optionally provided in the circulating air line system, the throughflow control device advantageously being arranged in a feed channel or a return channel of the circulating air line system. There are further optionally provided in the circulating air line system a heat exchanger and/or a heating device, the heat exchanger preferably transmitting heat from an exhaust gas flow into a fresh air flow within the device for supplying fresh air to the receiving region and a heating device preferably being connected, for example, to a solar thermal energy installation and/or a gas burner.

The line with the opening for drawing in fresh air may in particular open into a feed channel or return channel within the circulating air line system.

The installation may also contain a device for supplying fresh air to the receiving region, which device has at least one line which has an opening for drawing in fresh air and which is connected directly to the process chamber.

The throughflow control device is preferably part of a (superordinate) control or regulation circuit which supplies the receiving region with conditioned fluid, in particular with fresh air and optionally returned, prepared exhaust air. The throughflow control device may be connected directly or indirectly to a control or regulation circuit which contains a device for detecting a status parameter of the process chamber and which controls or regulates the quantity of fresh air which is introduced into the receiving region by means of the throughflow control device.

The process chamber in the installation may contain a device for monitoring operation of the process chamber, which device is configured for detecting a status parameter from the group set out below:

i. carbon content and/or solvent content of the atmosphere in the receiving region;

ii. number and/or weight and/or type and/or size of the surface of workpieces which are arranged in the receiving region;

iii. number and/or weight and/or type and/or size of the surface of workpieces supplied to the receiving region per time unit;

iv. temperature of the exhaust air of a burner in a device for the temperature control of circulating air;

v. temperature difference of gaseous fluid which is removed from the receiving region and which is supplied to the receiving region again;

vi. temperature difference of gaseous fluid from the receiving region which is supplied to a combustion chamber of a burner in a device for the temperature control of circulating air, and of exhaust air from the combustion chamber of the burner;

vii. heat quantity per time unit which is supplied to the process chamber.

The process chamber in the installation can also be constructed with a receiving region which is subdivided into a first receiving region and an additional receiving region, the device for introducing gaseous fluid into the inner space producing a fluid stream curtain between the first receiving region and the additional receiving region.

The device for introducing gaseous fluid into the inner space of the process chamber contains at least one nozzle or at least one aperture for producing a fluid stream curtain between the portal and the receiving region for workpieces. The at least one nozzle or at least one aperture is preferably used as a discharge opening for air which has been heated above ambient temperature and/or air which is compressed above ambient pressure (or a correspondingly processed inert gas such as $CO_2$ or $N_2$).

The process chamber may contain, for example, gaseous fluid whose temperature T is above 100° C. and/or for which a temperature difference in relation to the environment of the process chamber is more than 50° C. In an embodiment, fluid is introduced approximately perpendicularly in a downward direction into the process chamber. In another preferred embodiment, the fluid introduced through the nozzle has a temperature which is higher or lower by more than 20° C. than the (approximately static) fluid contained in the process chamber. Reference is further made mainly to a rigid or adjustable nozzle geometry, the invention also being able to be carried out with one or more simple apertures, respectively.

The inner space of the process chamber is preferably constructed so as to be of tunnel-like form. It has a floor and a ceiling. In that the at least one nozzle is in the form of a slot-type nozzle having a substantially rectangular discharge cross section, the gaseous fluid can be supplied via the ceiling of the inner space with a flow direction which is oblique in relation to the floor so that a flow eddy which comprises air and which is at least partially mixed with introduced fluid is formed at the side of the fluid stream curtain, which side is directed toward the floor or the inlet portal.

A notion of the invention is particularly that the fluid stream curtain can be produced with reduced energy consumption if the gaseous fluid which is introduced into the inner space via the at least one nozzle is guided by means of a guiding contour which projects into the inner space. It is particularly advantageous if that guiding contour can be pivoted. As a result, it is possible to adjust the fluid stream curtain in relation to the horizontal. An angle between 80° and 50° between the discharge direction and the horizontal is preferably adjusted.

If this angle between the discharge direction and the horizontal is adjusted, the fluid stream curtain produces a flow eddy at the lower side thereof when viewed in the flow direction, which side is directed toward the floor or a portal. The fluid flow of the fluid stream curtain presses counter to the gaseous fluid which is located in the region of the floor of the process chamber. The fluid flow of the fluid stream curtain overlaps and becomes mixed with fluid which leaves the process chamber in the region of the floor. In particular, it is possible by the guiding contour being pivoted for workpieces not to be impaired during introduction into the process chamber or during discharge.

It is particularly advantageous if a wall which defines with the guiding contour a diffuser which contains a mixing chamber is arranged at the side of the guiding contour directed toward the portal. In relation to the central flow direction of the gaseous fluid from the at least one nozzle, the diffuser is constructed in an asymmetrical manner. The mixing chamber in the diffuser is arranged at the side of the fluid stream out of the nozzle, which side is directed downward when viewed in the flow direction.

The mixing chamber is positioned in the diffuser in such a manner that fluid at a side of the fluid stream curtain, which side is directed toward the portal (that is, outward from the inner space of the process chamber), is mixed with air from the region of the portal. In this instance, the air is drawn into the eddy by the gaseous fluid which flows through the nozzle or the aperture.

The wall may have one or more openings for the introduction of circulating air from the region of the portal.

In that an auxiliary chamber which acts as a "dead space" for gaseous fluid is formed at a side of the guiding contour directed away from the mixing chamber, it can be ensured that the stream of gaseous fluid being discharged from the nozzle or aperture is guided along the guiding contour without any flow breakdown. Preferably, lower flow speeds are present in the "dead space" than outside the dead space. As a result of the arrangement of an additional guiding wing in the mixing chamber, it is possible for large quantities of fluid to be guided back from the flow eddy into the fluid stream curtain.

In that a front wall which defines a retention space with the guiding contour is arranged at the side of the guiding wing directed toward the inlet portal, circulating air from the region of the inlet portal can be prevented from being discharged into the atmosphere, which air is redirected in the region of the guiding wing into an edge region of the inner space.

The front wall advantageously has one or more openings for the introduction of circulating air from the region of the inlet portal. The at least one nozzle may have a device for adjusting the flow quantity which is introduced through the nozzle for fluid. In that a plurality of nozzles having a device for adjusting the flow quantity which is introduced through the nozzle for fluid are provided, the fluid stream curtain can be adjusted in different manners in different portions between the inlet portal and the receiving region for workpieces.

The device for introducing gaseous fluid may have a heating device for heating the gaseous fluid. It is thereby possible for no condensate, for example, condensation water, to be produced in the region of portals of the process chamber. The process chamber is suitable for use in a drying and/or hardening installation. In particular, the process chamber may be integrated in a painting installation.

The fluid stream curtain is produced in the process chamber with gaseous fluid which is acted on with pressure and which is guided through a nozzle. Air from the region of a portal of the process chamber is added in the mixing chamber arranged adjacent to the nozzle to the gaseous fluid which flows out of the nozzle. The gaseous fluid which is guided through the nozzle is guided along a guiding contour which delimits the mixing chamber. That guiding contour separates the mixing chamber from an auxiliary chamber which is arranged adjacent thereto and which acts as a dead space for gaseous fluid.

The process chamber can be operated in particular in such a manner that a stream of gaseous fluid guided through a nozzle for producing a fluid stream curtain between the portal and the receiving region for workpieces is throttled or interrupted and/or wherein the direction of the fluid stream curtain is changed if a workpiece is moved through the portal. This ensures that the fluid stream curtain does not damage the surface of the coating of workpieces which are moved into and out of the process chamber.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
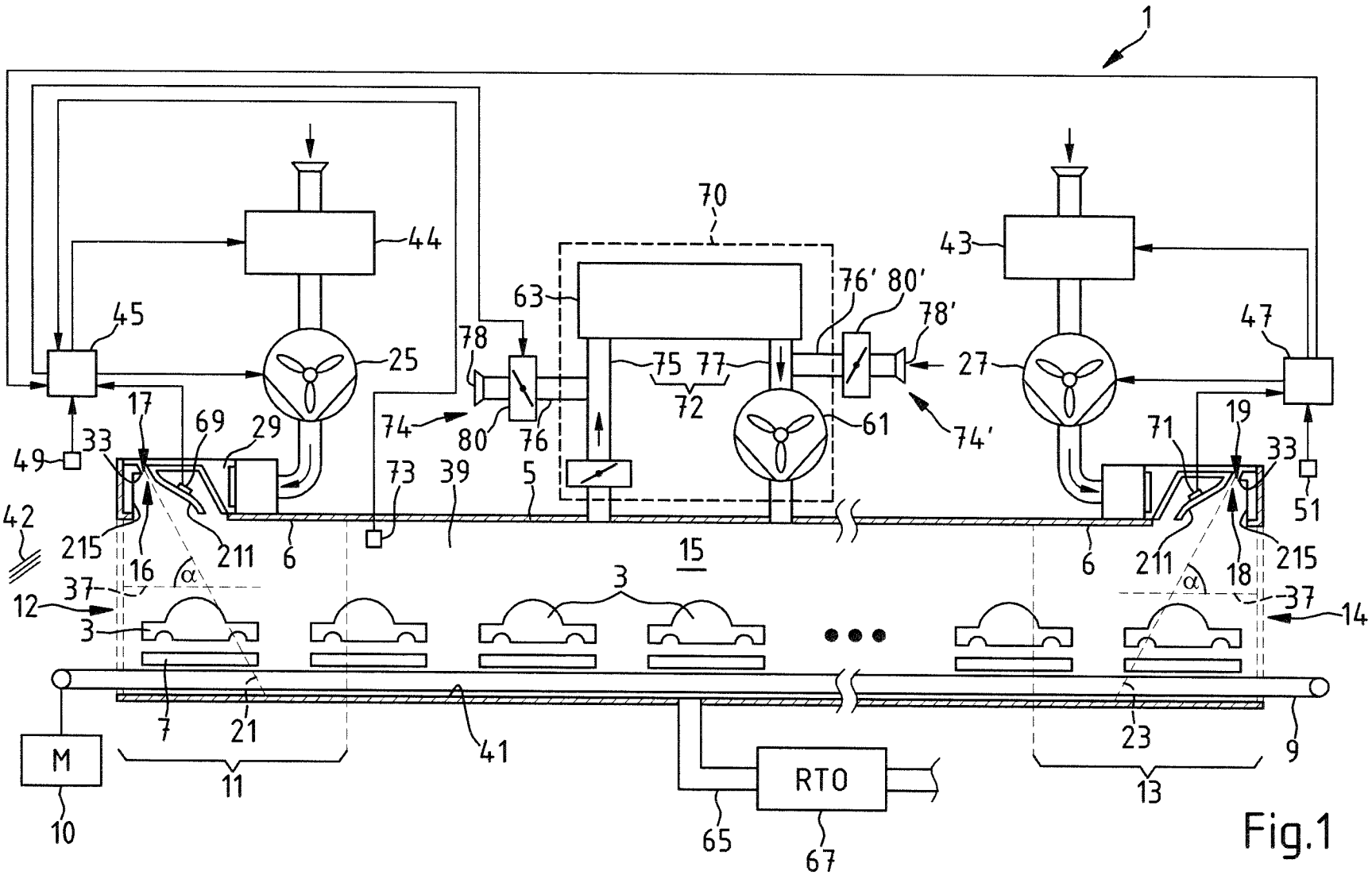
FIG. 1 shows a first drying installation for vehicle bodyworks.

The installation 1 shown in FIG. 1 for drying, for example, metal workpieces is configured in particular for vehicle bodyworks 3. The installation 1 comprises a process chamber which is in the form of a drying tunnel 5. The vehicle bodyworks 3 which are mounted on skids 7 can be moved through the drying tunnel 5 by a conveying device 9. The conveying device has an electrical drive 10. The drying tunnel 5 is lined with sheet metal. It has an inlet lock 11 having an inlet portal 12 and an outlet lock 13 having an outlet portal 14. The drying tunnel 5 comprises a drying zone 15 which is located between the inlet lock 11 and the outlet lock 13. The drying zone 15 is a receiving region for workpieces. The drying zone 15 is preferably configured in such a manner that approximately fifteen vehicle bodyworks 3 which are freshly coated with a substrate which contains paint and/or a solvent can be dried therein more or less at the same time. To this end, the drying portion 15 is configured, for example, with the length L=40 m, a clear width b of 1.40 m<b<2.70 m and a clear height h of 2.00 m<h<2.60 m. In a particularly preferred embodiment, for interval spacing of 5.2 m, thirty units per hour and 0.5 hours of dwell time, there is produced a tunnel length of 78 m (external width b: from 3 m to 4.6 m, external height h: from 2.8 m to 3.3 m). Fluid for drying is supplied to the drying portion 15 by means of a device 70 for providing conditioned gaseous fluid.

The device 70 preferably contains a circulating air line system 72 which communicates with the drying zone 15. The circulating air line system 72 communicates with the receiving region 15 and has a feed channel 75 which acts as a circulating air recirculating channel and contains a return channel 77 which acts as a circulating air return channel for returning the circulating air. The circulating air line system 72 is guided through a heating device 63. In the device 70, there is a ventilator 61 with which the air for drying is introduced. With the device 70, the air can be retained at a defined temperature in the drying zone 15 in a circulating air operating state.

The installation 1 further preferably contains a device 74 and alternatively or additionally a device 74' for the supply of fluid in the form of fresh air, which may optionally also be conditioned. The device 74, 74' has a line 76, 76' having an opening 78, 78' for drawing in fresh air. In the line 76, 76' there is a throughflow control device 80, 80' which is constructed as a throttle valve. The line 76, 76' is advantageously connected to the circulating air line system 72.

In order to direct away from the fluid atmosphere solvent which becomes volatilized in the drying tunnel 5 from paint, adhesives or coatings of the vehicle bodyworks 3, there is in the installation 1 a line 65 or a plurality of lines for exhaust air, via which air charged with solvent can be supplied from the drying tunnel 5 to a cleaning reactor 67.

In the inlet lock 11 and the outlet lock 13 of the drying tunnel 5 there is a nozzle 17, 19 for producing a fluid stream curtain 21, 23. The nozzles 17, 19 are supplied with fresh air via a ventilator acting as a compressor for fresh air 25, 27 by a chamber 29, 31 which is arranged above the ceiling 6 of the drying tunnel 5. The nozzles 17, 19 preferably each have a narrow slot-like opening 33, 35 which extends substantially over the width of the drying tunnel 5 or over the width of the inlet or outlet portals 12, 14. The slot-like opening 33, 35 of the nozzles 17, 19 opens in the inner space 39 of the drying tunnel 5. The fluid being discharged from the nozzles 17, 19 is directed via a diffuser 16, 18 into the inner space of the drying tunnel 5. The diffuser 16, 18 extends in front of the nozzles 17, 19 over the width of the inlet or outlet portal 12, 14. The diffuser 16, 18 is constructed asymmetrically in relation to the direction of the fluid stream curtain 21, 23 and is delimited by a guiding plate having a guiding contour 211 and a front wall 215. The fluid which flows out of the nozzles 17, 19 is directed into the inner space of the drying tunnel by the guiding contour 211 of the guiding plate. A temperature sensor 69, 71 is located on the guiding contour 211 for detecting in a manner, which is advantageously possible, the temperature T of the fluid which is supplied to the inner space 39 via the nozzles 17, 19.

The fluid stream curtain 21, 23 preferably extends at an angle of $50° \leq \alpha \leq 80°$ with respect to the horizontal 37. It is directed into the inner space 39 of the drying tunnel 5. The fluid stream flowing out of the nozzles 17, 19 expands toward the floor 41 of the drying tunnel 5. With increasing distance from the opening 33, 35 of the nozzles 17, 19, the speed of the flow of the fresh air, which forms the fluid stream curtain 21, 23 as a gaseous fluid, decreases. The fluid stream curtain 21, 23 separates the gas atmosphere in the inner space 39 of the drying tunnel 5 from the ambient air 42. The fluid stream being discharged from the nozzles 17, 19 is adjusted to a predetermined shape by means of a control device 45, 47.

A solvent sensor 73 is arranged in the drying zone 15 for detecting the concentration of solvent in the gas atmosphere of the drying tunnel 5. Alternatively or additionally, such a solvent sensor may be arranged in the exhaust air channel 65. The gaseous fluid in the form of air supplied to the nozzles 17, 19 is preheated in a heating device 43, 44 to a desired process temperature $T_{sol1}$ which is preferably in a temperature range of $160° C. \leq T_{sol1} \leq 250° C$. In that the fluid stream curtain 21, 23 comprises fresh air, it can be ensured that a lower explosion limit for organic solvents in the drying zone 15 of the drying tunnel 5 is not exceeded. The preheating of the supplied fluid causes condensate not to occur in the inlet lock 11 and the outlet lock 13 of the drying tunnel 5.

In order to ensure that the explosion limit in the drying zone 15 is complied with, fresh air can be introduced into the drying portion 15 where applicable via the device 74 or 74'.

The control device 45 is connected to the throughflow control device 80 for adjusting the quantity of the fresh air supplied to the drying tunnel 5 via the device 74 or 74'. With the control device 45, the fresh air supplied via the line 76 or 76' is adjusted to a predetermined value. The adjustment of the fresh air supply is carried out in accordance with the number detected by means of a sensor 49, 51 as process chamber operating state parameters in respect of the vehicle bodyworks moved per time unit through the drying zone 15 of the drying tunnel 5 and/or on the basis of the signals of the temperature sensors 69, 71 and/or the solvent sensor 73 and/or one or more other process chamber operating state parameters which allow statements concerning the composition of the gas atmosphere in the drying tunnel 5 and therefore the establishment of the fresh air requirement when the drying tunnel 5 is operated. The fresh air supply is adjusted in such a manner that, when the installation 1 is operated, the so-called lower explosion limit of the composition of the gas atmosphere in the drying tunnel 5 is not exceeded.

In order to detect process chamber operating state parameters, in a modified embodiment of the installation 1, there may also be provided as an alternative to the sensor 49 a photoelectric barrier for establishing the number of vehicle bodyworks moved per time unit through the drying tunnel 5. Alternatively or additionally to the sensor 49, it is also possible for this purpose to provide the installation with a measurement device with which the weight of the vehicle bodyworks 3 supplied to the drying tunnel 5 can be established and/or to provide a device with which the size of the surface of the vehicle bodyworks 3 provided with a surface coating can be detected. Furthermore, the installation 1 may also be provided with a device for detecting a digital code which is fitted to workpieces, for example, the vehicle bodyworks 3 or a skid 7, for example, a bar code which contains digital information concerning the size and quality of a surface coating which is applied to a workpiece, for example, to a vehicle bodywork 3, or a specific workpiece type.

In an installation according to the invention, the establishment of the fresh air requirement of the process chamber, in particular a drying tunnel for motor vehicle bodyworks, may be carried out, for example, as follows on the basis of a predefined type of workpiece:

The mass and number of workpieces which are present in the process chamber or which are on the way into the process chamber is established by means of a mass detection device and a batch number detection device. For each measurement value of the mass of a workpiece taking into consideration variations to be anticipated, which is taken into consideration as a result of the workpieces to be processed in the installation, a workpiece type is stored in the control device 45. In the control device 45, a conclusion can then be drawn from the type of workpiece established in the control device 45 with regard to the size of the painted surface of that workpiece. From the relevant value for the size of the surface, a fresh air requirement of the process chamber can then be determined via the solvent quantity discharged from this surface, which requirement is necessary so that, for example, the proportion of combustible solvent in the gas atmosphere of the process chamber 15 remains below the explosion limit.

According to the invention, therefore, in the installation a conclusion is drawn with regard to a specific workpiece, that is, a specific workpiece type, in particular from the mass of a workpiece established with the mass detection device. For the specific workpiece, a quantity of paint or coating applied thereto is then assumed and, from that assumed quantity of paint or coating, a conclusion is then drawn with regard to a solvent quantity taken up in the paint applied to the workpiece or the coating arranged thereon.

In combination with the batch number of the relevant workpieces in the process chamber, it is then possible to establish a total solvent quantity which is introduced into the process chamber during the drying of workpieces. The fresh air requirement for the process chamber can then be established therefrom in order to operate the chamber below the explosion limit.

It may be noted that a device for detecting the mass and batch number of workpieces may be formed according to the invention, for example, as a weighing device, with which the number of weighing operations is detected.

In order to take into account the thermal inertia of the entire system, it is advantageous to fit a device for detecting a workpiece parameter upstream of the process chamber. In the remaining time until the introduction of a workpiece into the process chamber, a desired process temperature and/or a desired composition of the gas atmosphere can then be adjusted in the process chamber, for example, by means of the quantity of fresh air introduced into the process chamber.

It should also be noted that the thermal inertia of an above-described installation is substantially determined by the thermal capacity of the process chamber and the magnitude of the air quantities supplied thereto and discharged therefrom.

In that the above-mentioned devices are connected to the control device 45, it is possible to control or to regulate the composition of the gas atmosphere by adjusting the fresh air supply in accordance with the requirements of the vehicle bodyworks 3 which are arranged in the drying tunnel 5 in particular taking into consideration the solvent content in the surface coating of the vehicle bodyworks 3.

The installation 1 can therefore be operated, for example, in the following operating states:

Operating State 1:

With the fluid stream curtain 21, 23, a constant fresh air volume flow is supplied into the inlet or outlet locks 11, 13 and ensures not only adequate sealing of the inner space 39 but also adequate dilution of a solvent content in the atmosphere of the drying zone 15. The drying tunnel 5 is acted on here in a charge-independent manner with the volume flow which is necessary for the solvent quantity supplied in the case of full loading.

Operating State 2:

With the fluid stream curtain 21, 23, a constant fresh air volume flow is supplied into the inlet or outlet locks 11, 13 and ensures adequate sealing of the inner space 39. In order to ensure adequate dilution of the solvent content in the atmosphere of the drying zone 15, additional fresh air is supplied by means of the device 74. The quantity of fresh air supplied with the device 74 is adjusted with the control device 45 and changes with the charging of the installation 1. If fresh air is supplied to the drying zone 15 in an increased manner, a corresponding quantity of exhaust air must simultaneously be removed from the drying tunnel 5 via the line 65 so that the installation 1 is in equilibrium and no over-pressures or under-pressures are produced in the drying tunnel 5.

Figure 2:
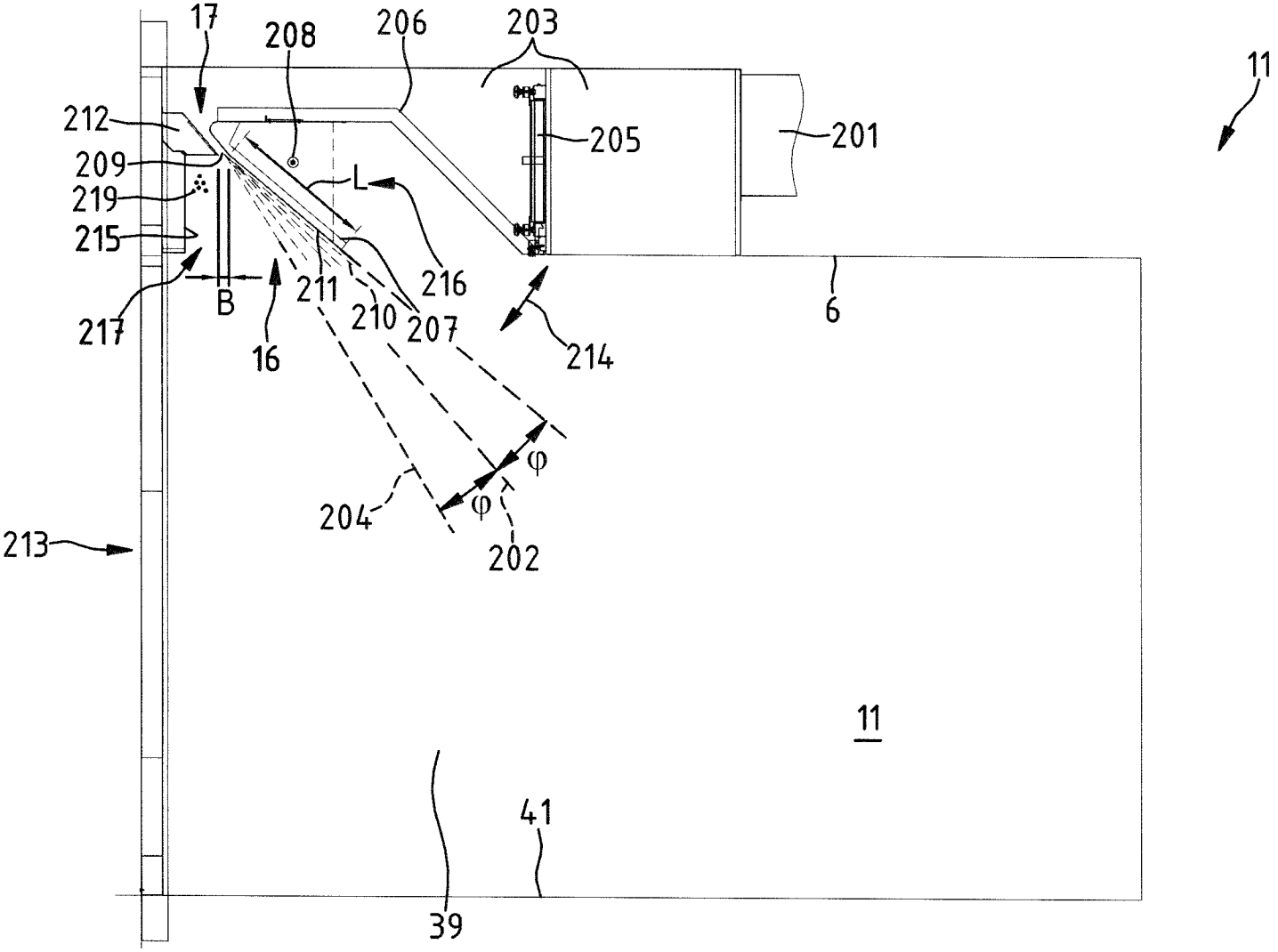
FIG. 2 is a longitudinal section of a lock of the drying installation.

FIG. 2 is a sectioned view of the inlet lock 11 of the drying installation 1 from FIG. 1. The nozzle 17 in the inlet lock 11 is a slot-type nozzle. The fresh air heated in the heating device 44 is supplied to the nozzle 17 via a pipeline 201. The pipeline 201 opens in a chamber 203. In the chamber 203, the fresh air is directed to the nozzle 17 via air filters 205 and an obliquely arranged housing plate 206. There is a guiding plate 207 in the lock 11. The guiding plate 207 is securely connected to the housing plate 206. The guiding plate 207 and the housing plate 206 can be pivoted in the lock 11 about a rotation axis 208 in the direction of the arrow 214. The pivoting of the guiding plate 207 with the housing plate 206 affords access to the filter 205 so that maintenance operations can be carried out there. The nozzle 17 has a slot-like opening 209. The slot-like opening 209 of the nozzle 17 is arranged so as to be recessed with respect to the ceiling 6 of the drying tunnel 5. This makes it possible for impairments and damage of an as-yet-non-dried coating of vehicle bodyworks, which are being moved through the inlet lock 11 into the drying tunnel 5, to be able to be avoided even at high flow speeds of a fluid stream being discharged from the nozzle 17. The important aspect for preventing such damage is a comparatively large spacing of the opening 209 of the nozzle 17 from the floor 41 of the drying tunnel 5. This can be achieved by a recessed arrangement of the nozzle 17 in the drying tunnel 5. This ensures that the impulse of the gaseous fluid flowing out of the nozzle 17 is already weakened at the center of the drying tunnel to such an extent that corresponding coatings of vehicle bodyworks 3 cannot be damaged by the fluid stream curtain 21.

The fluid stream 210 being discharged from the opening 209 of the nozzle 17 is guided into the interior of the drying tunnel 5 along the contour 211 of a guiding plate 207 acting as a guiding wing. The length L of the contour 211 of the guiding plate 207 preferably corresponds to from 20 times to 40 times the slot width B of the nozzle opening 209.

At the side of the contour 211 directed toward the inlet portal 213 of the drying tunnel 5, there is a front wall 215. The front wall 215 extends over the width of the lock 11. The front wall 215 delimits the diffuser 16 with the contour 211, a ridge element 212 and the contour 211 of the guiding plate 207. The diffuser 16 is constructed in an asymmetric manner in relation to the main flow plane 202 of the fluid which flows out of the nozzle 17. The main flow plane 202 and the contour of the guiding plate 211 are at an angle $\varphi$ relative to each other. The portion of the diffuser 16 which is at the side directed toward the front wall 215 in respect of the plane 204 which is symmetrical to the contour of the guiding plate 211 in relation to the main flow plane 202 and which encloses the angle $2\varphi$ with the contour of the guiding plate 211, acts as a mixing chamber 217 for gaseous fluid 219. The mixing chamber 217 is arranged so as to be recessed in relation to the ceiling 6 of the drying tunnel 5. The diffuser 16 with the mixing chamber 217 is in the lock 11 above the inlet portal 213. The mixing chamber 217 is adjacent to the inlet portal 213. The guiding plate with the contour 211 separates the mixing chamber 217 from an auxiliary chamber 216. The auxiliary chamber 216 opens in the interior 39 of the drying tunnel 5. The auxiliary chamber 216 forms a dead space for air from the drying tunnel 5. The auxiliary chamber formed at the rear of the guiding plate with the guiding contour 211 causes the fluid stream 210 to be guided on the guiding contour 211 as a result of the Coanda effect without any flow breakdown.

Figure 3:
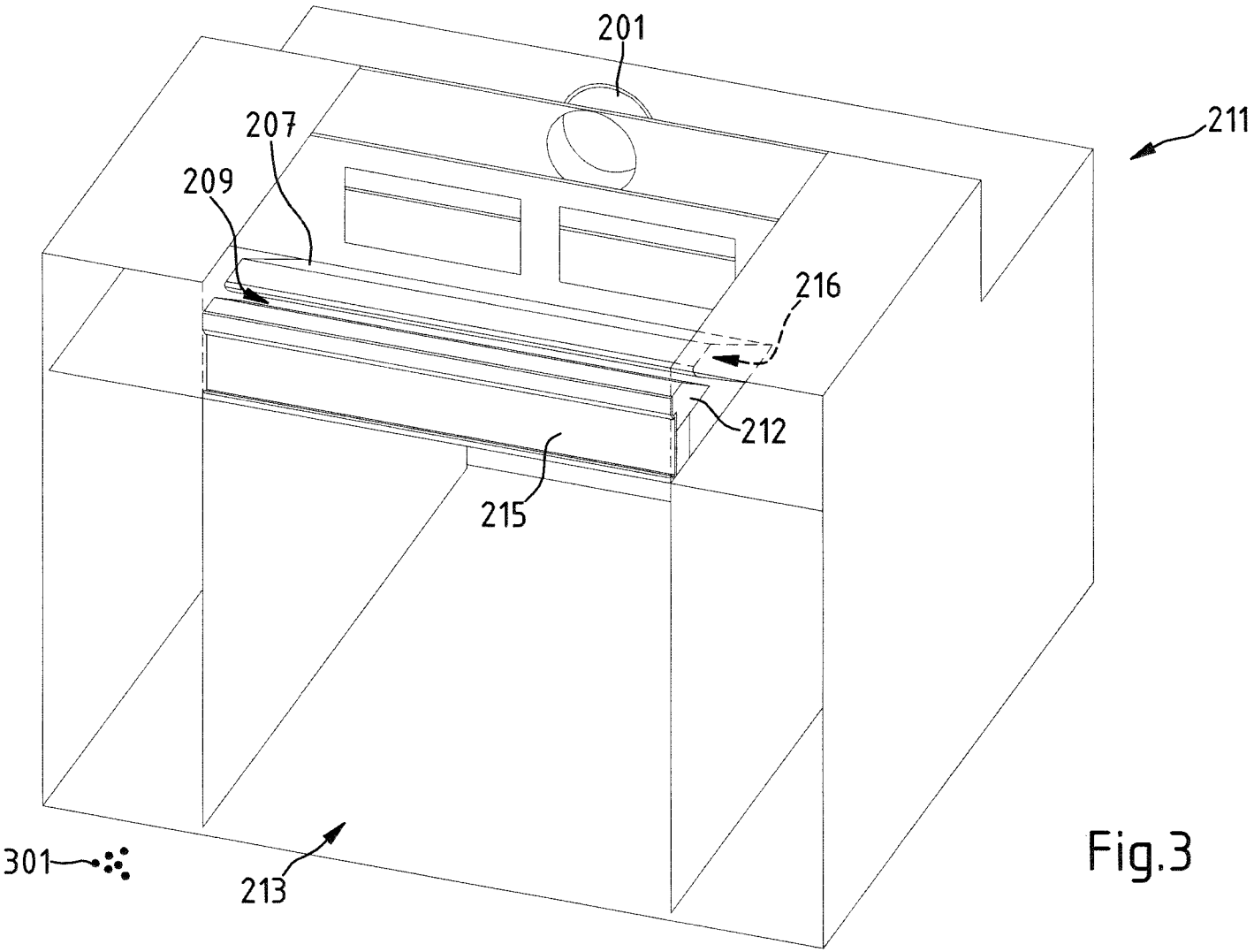
FIG. 3 is a three-dimensional view of the lock.

FIG. 3 is a three-dimensional view of the inlet lock 11 from FIG. 2. The slot-like opening 209 of the nozzle 17 extends over the entire width of the inlet portal 213 of the drying tunnel 5. The slot-like opening 209 of the nozzle 17 is so narrow that the fluid stream being discharged from the nozzle 17 forms a fluid stream curtain over a wide flow range with different discharge speeds. That fluid stream particularly prevents an introduction of dirt particles 301 from the environment of the drying installation 1 shown in FIG. 1 into the interior of the drying tunnel 5.

Figure 4:
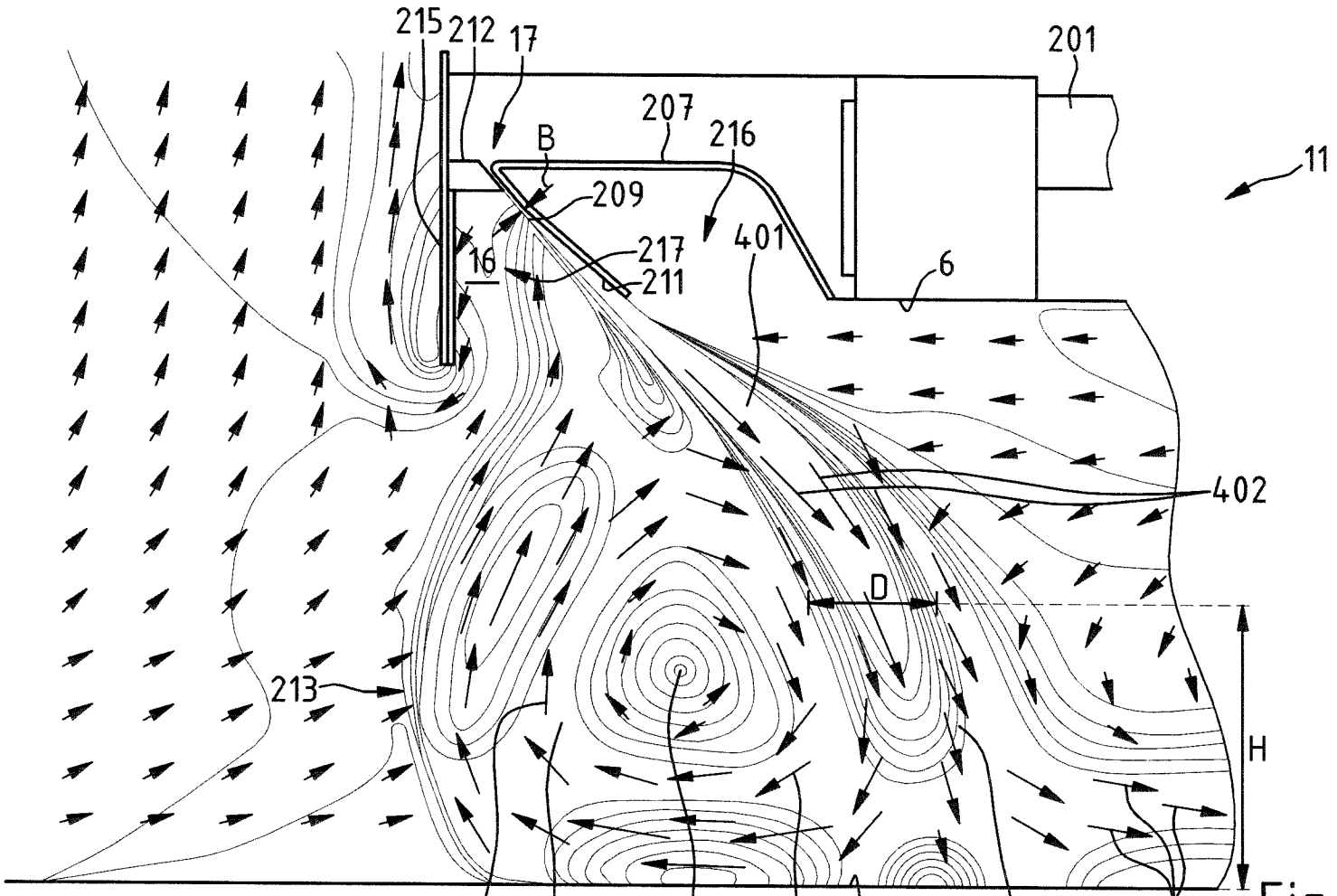
FIG. 4 shows the flow relationships for air in the region of the lock.

FIG. 4 shows with arrows the flow relationships for air in the inlet lock 11 in the plane of a longitudinal section of the drying tunnel 5 from FIG. 1. The fresh air which is supplied to the drying tunnel 5 via the slot-like nozzle 17 brings about a fluid stream curtain 401 at the outlet side of the nozzle 17. From the opening 209 of the nozzle 17, the fluid stream curtain 401 comprising fresh air flowing in the direction of the arrows 402 extends in the form of a bent leg 403 relative to the floor 41 of the inlet lock 11. The leg 403 has, at the height H of the center of the inlet lock 11, a thickness D which is determined by the width B of the opening 209 of the nozzle 17. At the side of the fluid stream curtain 401 directed toward the inlet portal 213 of the drying tunnel 5, the fresh air flowing out of the nozzle 17 produces a flow eddy 407 of air. In the flow eddy 407, the air flows with a flow direction which is indicated by the arrows 406 about a center 409. The air in the region of the center 409 is substantially not moved. The air circulating in the flow eddy 407 is mixed at least partially with the fresh air which is introduced via the nozzle 17. The flow eddy 407 extends from the floor 41 as far as the ceiling 6 of the inlet lock 11.

A diffuser 16 is formed by the guiding plate 211, on the one hand, and the front plate 215 which is arranged at the side of the guiding plate 211 directed toward the inlet portal 213, on the other hand. The diffuser 16 preferably takes up a portion of the air circulating in the flow eddy 407 inside the mixing chamber 217 thereof. In the mixing chamber 217, this air is carried and added to a portion of the gaseous fluid which flows out of the opening 209 of the nozzle 17 in the manner of a Venturi effect. This increases the volume flow of the fluid stream curtain 401 in the region of the arrows 402. The volume flow of the fluid stream curtain 401 may thus comprise a level of 30% or more of gaseous fluid which is supplied to the fluid stream which flows from the nozzle 17 via the mixing chamber 217. This results in a fluid stream curtain 401 which extends as far as the floor 41 of the drying tunnel 5 also being able to be produced with a comparatively small quantity of introduced fresh air.

The air from the mixing chamber 217 is thereby supplied to the flow eddy 407 again. This process results in only a small proportion of the gaseous fluid which is supplied via the nozzle 17 into the inner space 39 of the drying tunnel 5 leaving through the portal 213 of the lock 11 of the drying tunnel 5 again. The gaseous fluid which flows out of the nozzle 17 therefore reaches the interior of the drying tunnel 5 in accordance with the direction of the arrows 408 for the most part. A barrier with air circulating in the flow eddy 407 is produced in the region of the portal 213 of the lock 11 by means of the gaseous fluid which flows out of the nozzle 17. This barrier brings about a thermal separation of the inner space 39 of the drying tunnel 5 from the outer region. Furthermore, that barrier also prevents the introduction of dust and dirt particles into the inner space 39 of the drying tunnel 5.

Figure 5:
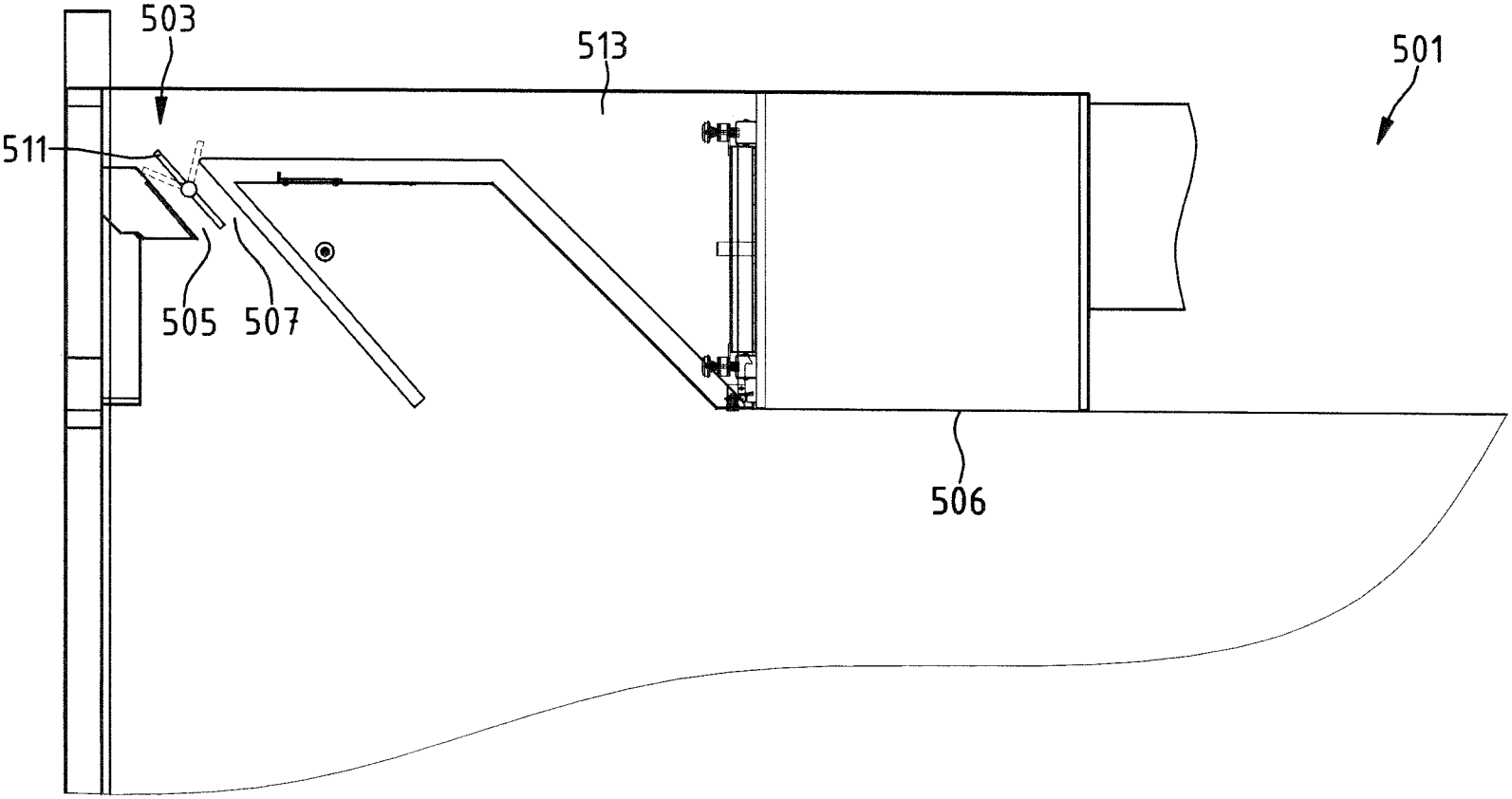
FIG. 5 is a longitudinal section of another lock for a drying installation.

FIG. 5 shows a modified embodiment of a lock 501 for a drying installation. The lock 501 has a nozzle 503 for the supply of fresh air with a nozzle geometry which is modified in comparison with the lock 11 from FIG. 1. The nozzle 503 is a double-chamber nozzle. The nozzle 503 has a slot-like nozzle opening 505 and a slot-like nozzle opening 507 which extends over the entire width of the cover 509 of the inlet lock 501. The nozzle 503 comprises a pivotable control valve 511. The control valve 511 can be moved by means of a spindle drive which is not shown in greater detail. However, an adjustment mechanism having a shaft or a cable control is also suitable for moving the control valve. By pivoting the control valve 511, the fresh air supplied to the nozzle 503 via the chamber 513 may optionally be directed through the nozzle opening 507, the nozzle opening 505 or through the nozzle openings 507, 505 simultaneously. This allows the air stream which is discharged from the nozzle openings 507, 505 to be metered. For example, it is possible by means of the control valve 511 to vary the air stream from the nozzle 503 in accordance with the position of vehicle bodyworks in the region of the inlet portal of a drying tunnel. It is thereby possible for a paint coating which is applied to a vehicle bodywork not to become impaired by the fluid stream which is formed with fresh air from the nozzle 503. Furthermore, it is possible by means of the control valve 511 to adjust the thickness D of the fluid stream curtain and therefore the quantity and/or the speed of the fresh air which is supplied to the interior of the drying tunnel.

In a modified embodiment of the inlet lock 501, it is also possible to provide a nozzle having a plurality of nozzle openings and having a plurality of control valves in order to adjust a fresh air stream for a drying tunnel.

Figure 6:
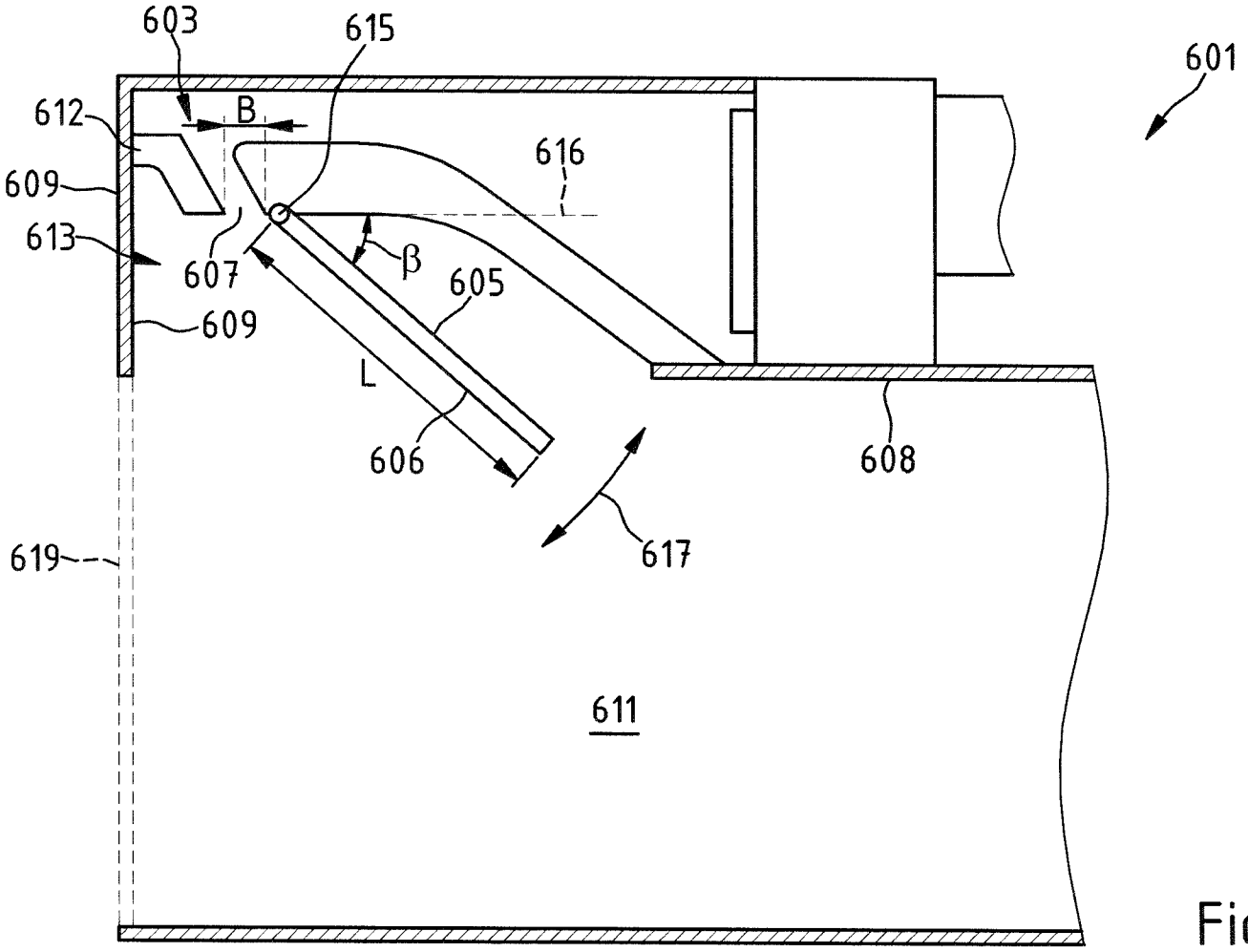
FIG. 6, FIG. 7 and FIG. 8 show portions of other longitudinal sections of alternative embodiments for locks in a drying installation.

FIG. 6 shows a portion of an alternative embodiment for a lock 601 having a nozzle 603 in order to construct an air curtain in the inlet or outlet region of a drying installation.

A preferably pivotably arranged guiding plate 605 which acts as a guiding wing is associated with the nozzle 603 in the lock 601. The guiding plate optionally has an outer contour, which is at least partially curved. In particular, it extends over the entire width of the nozzle 603. The pivotable guiding plate 605 in the case of the opening 607 of the nozzle 603 is pivotably supported on the ceiling 608 of the lock 601 on a rotary joint 615. The pivotable guiding plate 605 projects into the interior 611 of the lock 601. The length L of the contour of the guiding plate 605 substantially corresponds to from 20 times to 40 times the slot width B of the nozzle opening. A front wall 609 is again arranged in the lock 601 opposite the pivotable guiding plate 605. In this instance, the pivotable guiding plate 605 and the front wall 609 also define together with a ridge element 612 a diffuser with a mixing chamber 613. As a result of the pivotability of the guiding plate 605, the geometry of the diffuser and the mixing chamber 613 can be changed in the case of the lock 601.

For the pivoting action, an actuating drive which is not shown in greater detail is associated with the guiding plate 605. By pivoting the guiding plate 605 in accordance with the double-headed arrow 617, it is possible to adjust an angle of incidence β in relation to the horizontal 616 and therefore the direction of a fluid stream curtain which is produced with gaseous fluid from the nozzle 603 in the lock 601. The guiding plate 605, on which the gaseous fluid which flows out of the nozzle 607 is guided, is displaced by the pivoting action. The shape of the flow eddy can thereby be changed, which shape is formed as a result of the fluid which flows out of the nozzle 603 at the side of the guiding plate 605 directed toward the opening 619 of the lock 601. By the guiding plate 605 being pivoted toward the ceiling 608 of the lock 601, it is possible to bring about a comparatively planar introduction of gaseous fluid into the lock. By the guiding plate 605 being moved upward and downward, the flow direction of the fluid flowing out of the nozzle can be adapted to the position and geometry of vehicle bodyworks which are moved by the lock 601 into the interior of the drying tunnel. Thus, it is possible for the fluid which flows out of the nozzle not to be redirected by the vehicle bodyworks toward the portal 619 and a paint coating which is applied to vehicle bodyworks and which is intended to be dried in the drying tunnel not to be dispersed or to suffer damage in the drying tunnel.

Figure 7:
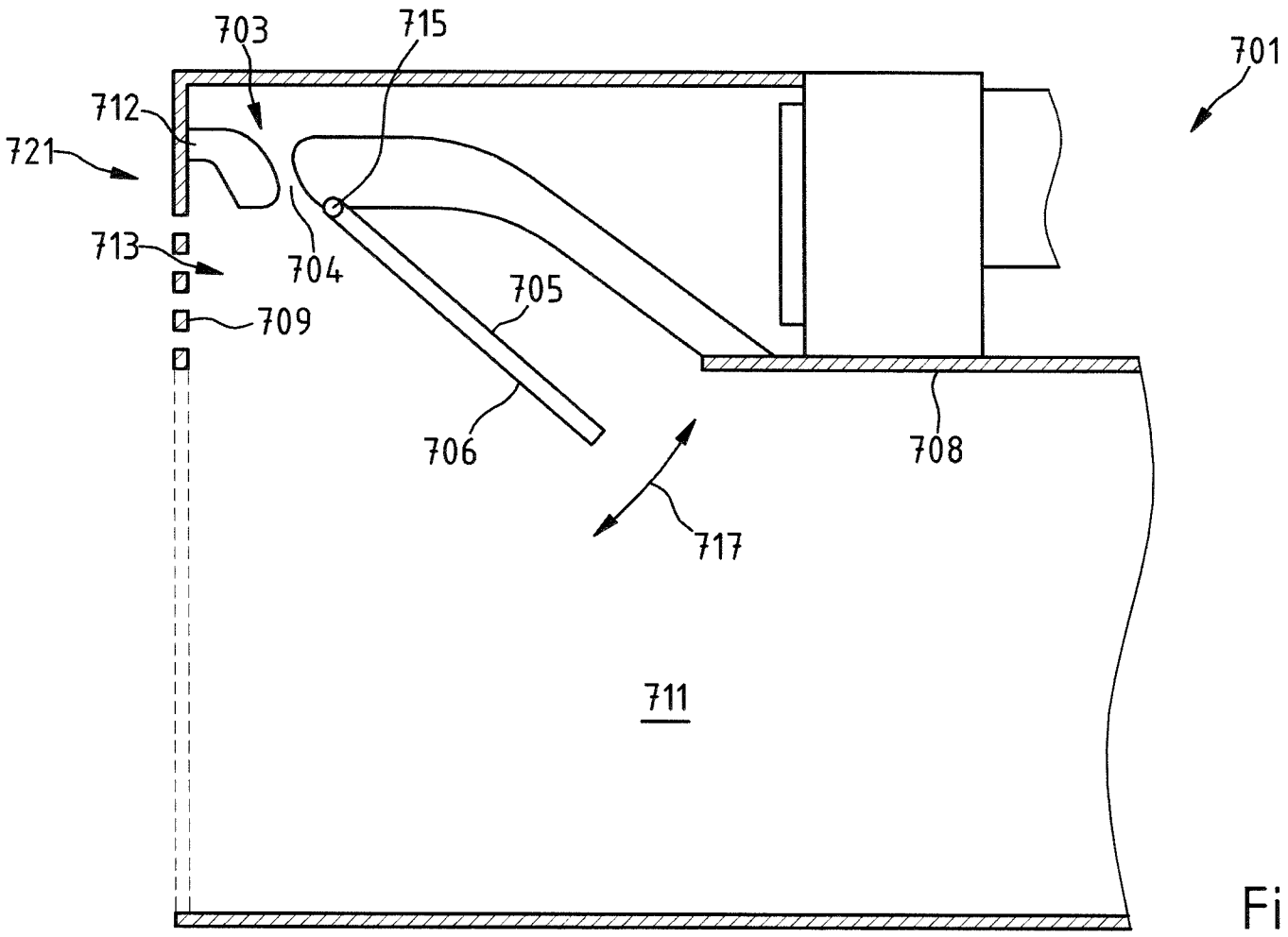

FIG. 7 shows a portion of another alternative embodiment for a lock 701 having a nozzle 703 in order to form an air curtain in the inlet region or outlet region of a drying installation. The nozzle 703 opens into a diffuser portion which adjoins the narrowed cross section of the nozzle and thus expands the cross section of flow for the fluid. The nozzle 703 with adjoining diffuser portion thus has a flow channel 704 whose cross section extends toward the interior 711 of the lock 701 into a volume which acts as a diffuser and in which a mixing chamber 713 is located.

The structure of the lock 701 further corresponds to that of the lock 601 from FIG. 6. Mutually corresponding subassemblies of the lock 601 and 701 are therefore indicated in FIG. 7 with reference numerals which are increased by 100 in comparison with FIG. 6. Unlike the front wall 609 of the lock 601 in FIG. 6, the lock 701 has a front wall 709 having one or more inlet openings for ambient air. The front wall 709 preferably has openings in the form of a sieve-like perforation. That measure also allows air to be drawn from an upper region 721 of the environment of the lock 701. The air which is drawn into the lock 701 in this manner is preferably mixed with air from a flow eddy which is formed at the portal of the lock. The drawn air and a portion of the air from the flow eddy are subsequently added to the fluid flow which is discharged from the diffuser.

Figure 8:
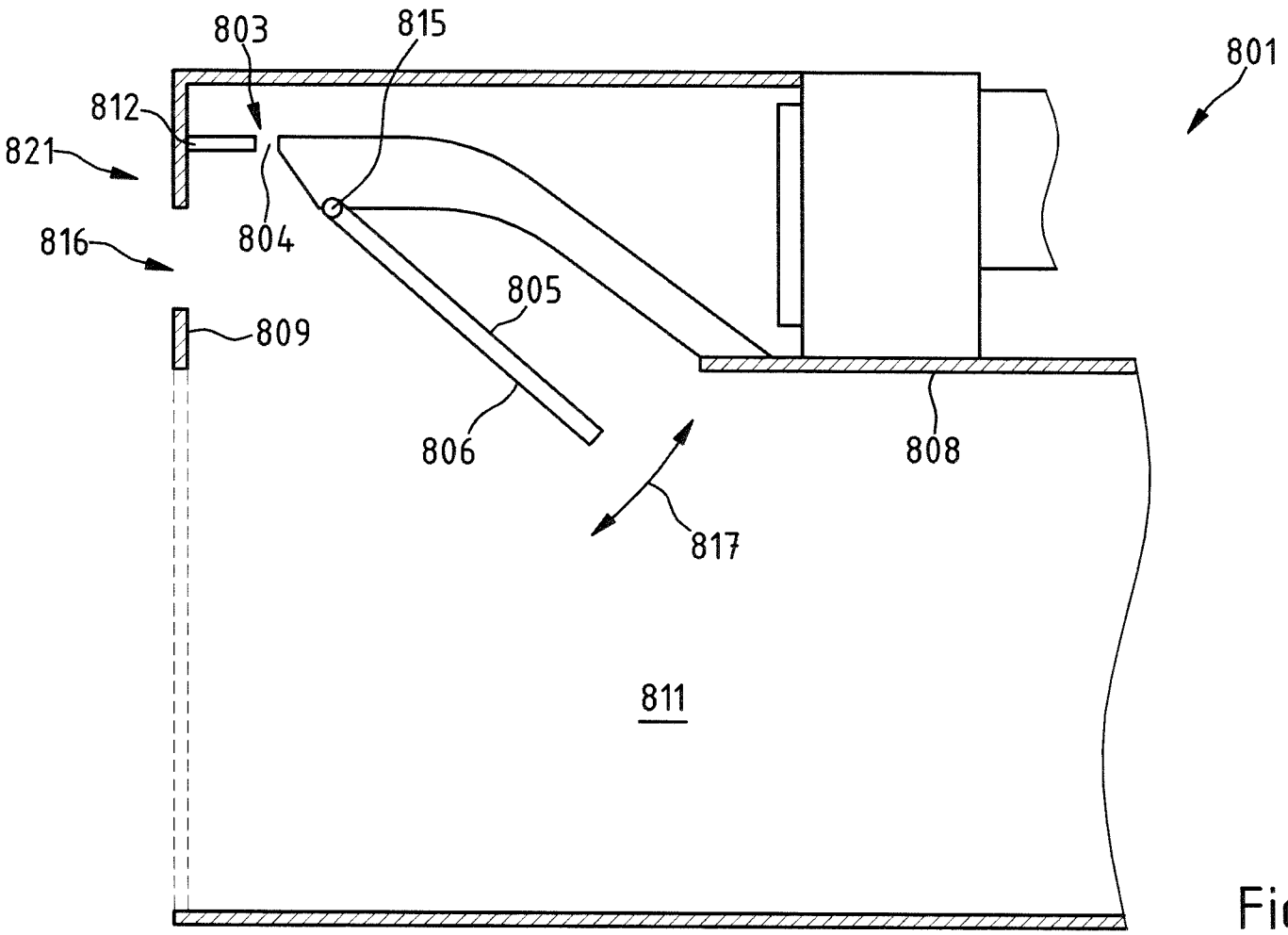

FIG. 8 shows a portion of another alternative embodiment for a lock 801 having an aperture 803 which has an opening 804 in order to form an air curtain in the inlet or outlet region of a drying installation. The structure of the lock 801 corresponds to that of the lock 701 from FIG. 7. Mutually corresponding subassemblies of the lock 701 and 801 are therefore indicated in FIG. 8 with reference numerals which are increased by 100 in comparison with FIG. 7. The front wall 809, the ridge element 812 and the guiding plate 805 here also delimit a diffuser which comprises a mixing chamber. Unlike the front wall 709 of the lock 701 in FIG. 7, the front wall 809 of the lock 801 is constructed so as to have a cutout 816. That measure also allows air to be drawn from an upper region 821 of the environment of the lock 801 into the flow eddy which is produced by means of the aperture 803 at the portal of the lock.

Figure 9:
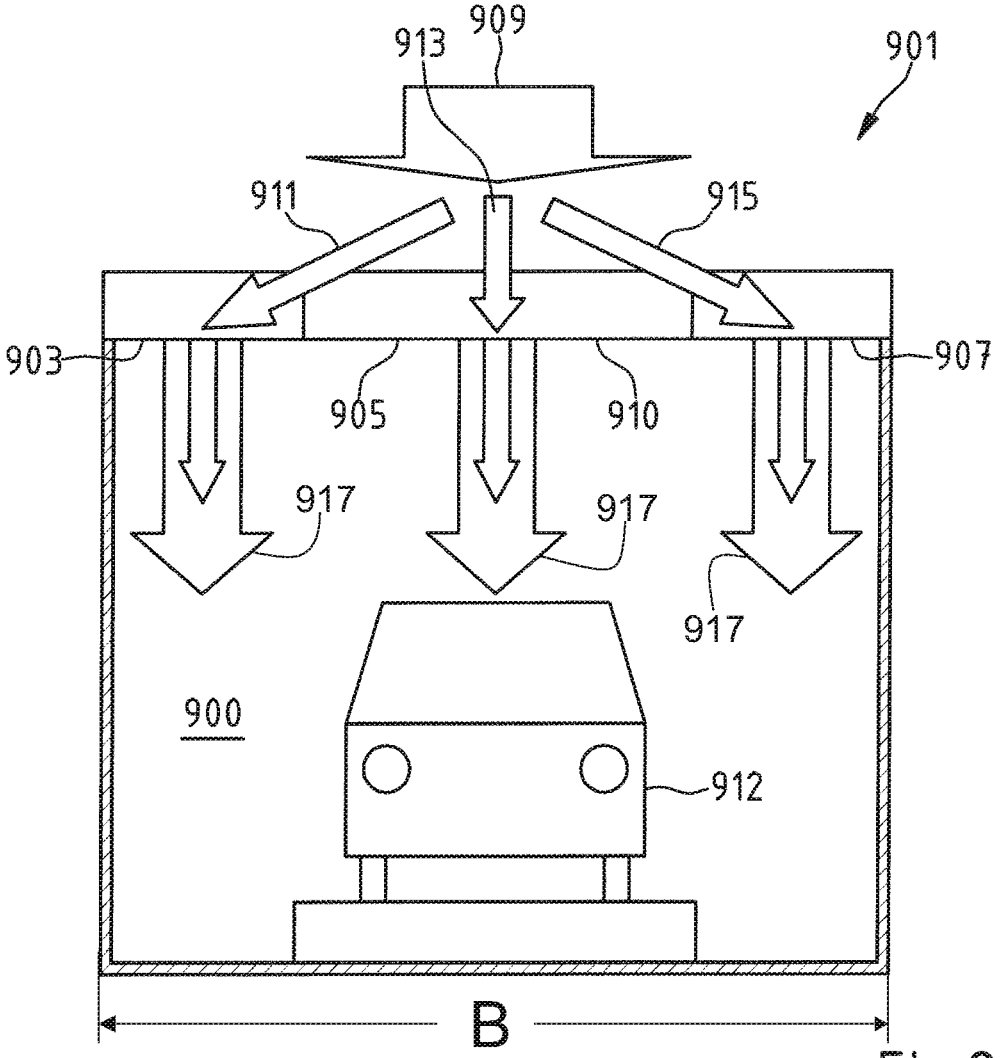
FIG. 9 is a cross section of a drying tunnel in a drying installation.

FIG. 9 shows a cross section of an inlet or outlet lock 901 of a drying tunnel 900 in a drying installation having a vehicle bodywork 912. The lock 901 has slot-like nozzles 903, 905, 907 which are located on the ceiling 910 of the lock 901. The nozzles 903, 905, 907 can be acted on by means of a device which is not shown in greater detail for supplying fresh air with a fresh air stream 909. In the lock 901, there are control valves by means of which the fresh air stream 909 can be divided between different channels 911, 913 and 915 for acting separately on the nozzles 903, 905 and 907 with fresh air.

This measure allows the adjustment of a fluid stream curtain 917 at the portals of a drying tunnel which can be adjusted differently in accordance with the passage of workpieces, for example, vehicle bodyworks over the width B of the portal.

Figure 10:
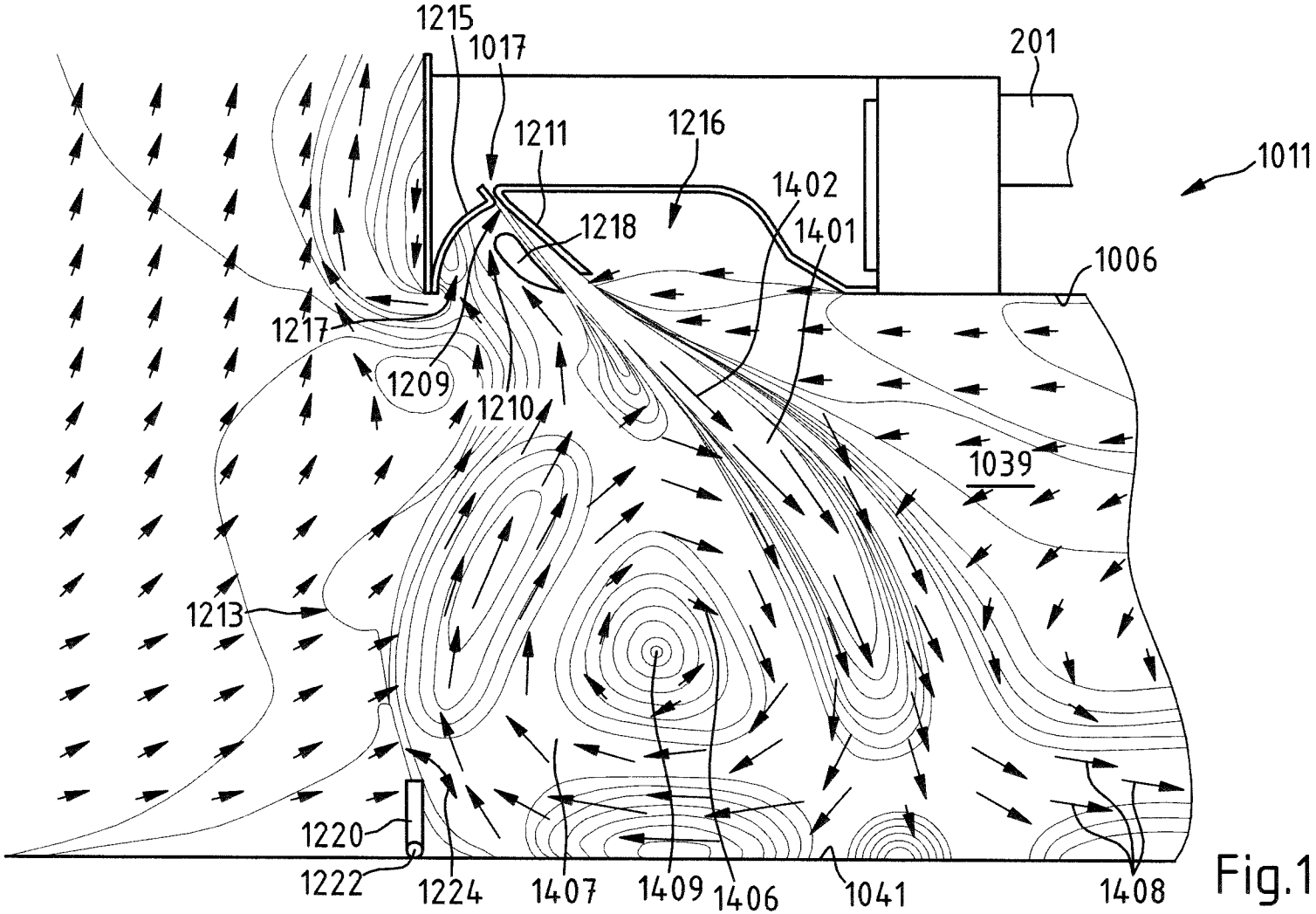
FIG. 10 is a longitudinal section of another lock.

FIG. 10 is a longitudinal section of another lock 1011 for a drying tunnel in an installation for drying metal workpieces. In accordance with FIG. 4, the flow relationships for air in the lock 1011 are also indicated with arrows in this instance. The fresh air which is supplied to the drying tunnel via the slot-like nozzle 1017 brings about a fluid stream curtain 1401 at the outlet side of the nozzle 1017.

On the basis of an opening 1209 of the nozzle 1017, the fluid stream curtain 1401 (preferably comprising fresh air which flows in the direction of the arrows 1402) extends in the form of a leg 1403 which is bent to a greater or lesser extent in the direction of a floor 1041 of the lock 1011. At a side of the fluid stream curtain 1401 directed toward the inlet portal 1213 of the lock 1011, the fresh air which flows out of the nozzle 1017 produces a flow eddy 1407 of air. In the flow eddy 1407, the air flows with a flow direction which is indicated by the arrows 1406 about a center 1409. The air in the region of the center 1409 is substantially not moved. The air which is circulating in the flow eddy 1407 is at least partially mixed with the fresh air which is introduced via the nozzle 1017. The flow eddy 1407 extends from the floor 1041 as far as the ceiling 1006 of the inlet lock 1011.

The lock 1011 has a curved ridge wall 1215 at the side of a guiding plate 1211 which has a guiding contour, which side is directed toward the inlet portal 1213. The guiding plate 1211 and the ridge wall 1215 delimit and surround partially a diffuser 1210 with a downwardly open mixing chamber 1217. In the embodiment according to FIG. 10, a flow guiding element 1218 in the form of a "flow wing", which preferably extends over the entire width of the lock 1011 similarly to the opening 1009 of the nozzle 1017, is positioned in the diffuser 1210. The guiding plate 1211 separates the diffuser 1210 from an auxiliary chamber 1216. The auxiliary chamber 1216 acts as a dead space for air, in which lower flow speeds than in the remaining lock are present (except for the actually negligible rotation center 1409 of the flow eddy).

A silhouette wall 1220 is arranged at the floor 1041 of the lock 1011 in the region of the portal 1213. The silhouette wall 1220 acts in particular as a flow barrier or as a flow guiding element at the floor side. The silhouette wall 1220 preferably comprises a spring steel or other temperature-resistant and/or corrosion-resistant steel. The silhouette wall 1220 can be pivoted or folded about a (horizontal) axis 1222 in accordance with the arrow 1224.

According to the invention, the mixing chamber 1217 takes up a small portion of the air circulating in the flow eddy 1407. In the mixing chamber 1217, this air is redirected with the flow wing 1218 as a result of a Venturi effect to the gaseous fluid which flows out of the opening 1209 of the nozzle 17. It is carried along by the gaseous fluid. That increases the volume flow of the fluid stream curtain 1401 in the region of the arrows 1402. The volume flow of the fluid stream curtain 1401 can thus comprise to a large degree gaseous fluid which is supplied to the fluid stream from the nozzle 1017 via the mixing chamber 1217 that results in a fluid stream curtain 1401 which extends as far as the floor 1041 of the drying tunnel also being able to be produced with a comparatively small quantity of fresh air being introduced.

The air from the mixing chamber 1217 is thereby supplied to the flow eddy 1407 again. That process results in only a small portion of the gaseous fluid which is supplied via the nozzle 1017 to the inner space 1039 of the drying tunnel leaving again through the portal 1213 of the lock 1011 of the drying tunnel. The gaseous fluid which flows out of the nozzle 1017 is therefore introduced into the interior of the drying tunnel for the most part in accordance with the direction of the arrows 1408. By means of the gaseous fluid which flows out of the nozzle 1017, there is produced in the region of the portal 1213 of the lock 1011 a barrier with air which is circulating in the flow eddy 1407 and which thermally separates the inner space 1039 of the drying tunnel from the outer region and furthermore also prevents an introduction of dust and dirt particles into the drying tunnel. The silhouette wall 1220 at the floor 1041 of the lock 1011 causes the flow eddy 1407 to be comparatively narrow. Only if a workpiece is moved into the drying tunnel does the silhouette wall in accordance with the arrow 1220 become folded briefly in the direction of the floor 1041. It should be noted that, alternatively or additionally, a foldable silhouette wall which corresponds to the silhouette wall 1220 can also be arranged in the upper region of the inlet portal.

Figure 11:
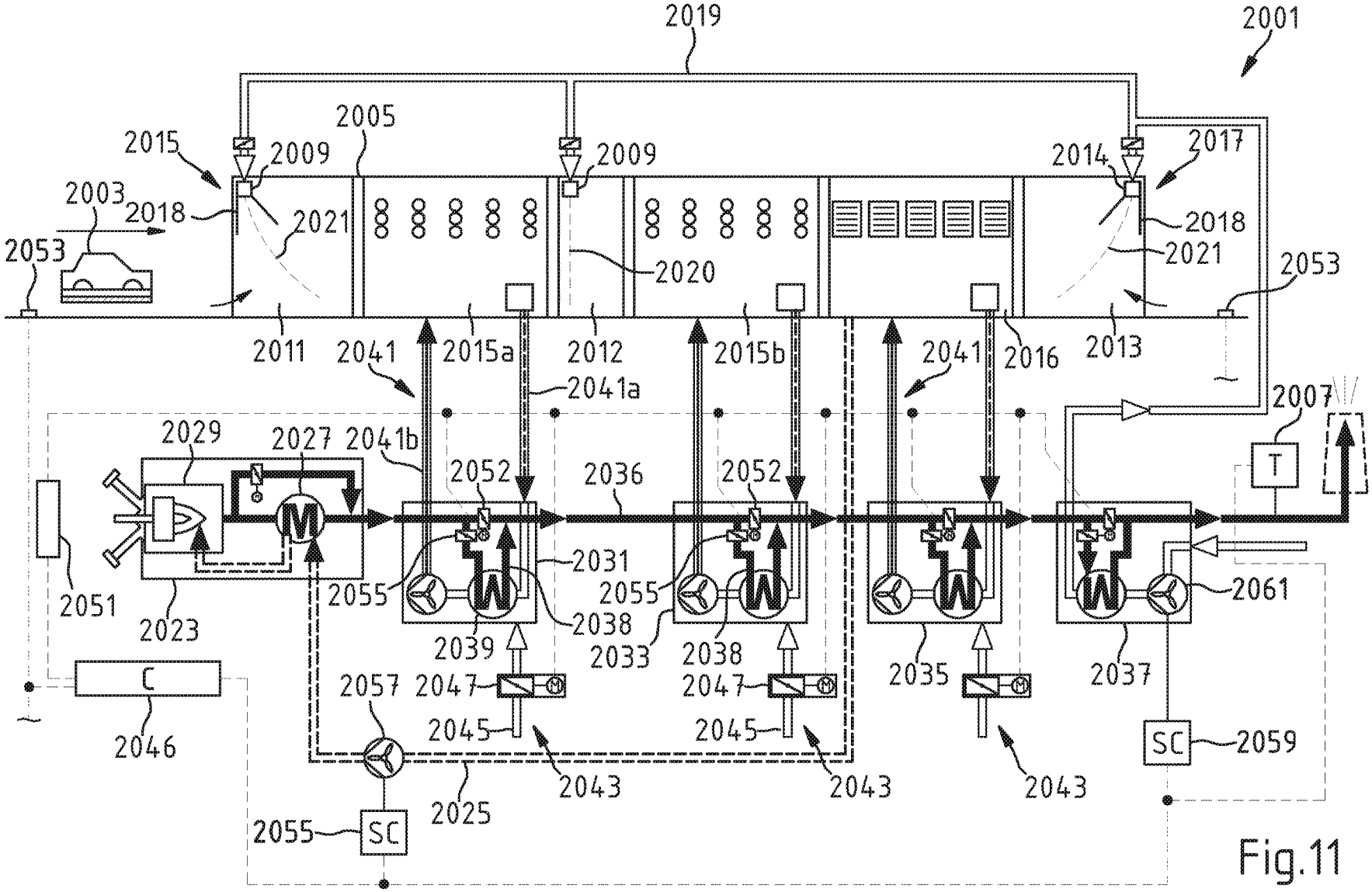
FIG. 11 shows a second drying installation for vehicle bodyworks.

The installation 2001 shown in FIG. 11 for drying vehicle bodyworks 2003 has a process chamber in the form of a drying tunnel 2005. The drying tunnel 2005 is constructed so as to have an inlet lock 2011, an intermediate lock 2012 and an outlet lock 2013. In the drying tunnel 2005, the intermediate lock 2012 separates a first drying portion 2015*a* from an additional drying portion 2015*b* as receiving regions for the motor vehicle bodyworks, which a retention zone 2016, which acts as an additional receiving region for motor vehicle bodyworks and which is arranged upstream of the outlet lock 2013, adjoins.

The structure of the locks 2011 and 2013 corresponds to the structure of the inlet and outlet lock 11, 13 in the installation 1 shown in FIG. 1 for drying. In at least one lock 2011, 2013, there is a nozzle 2014 for producing a fluid stream curtain 2021 which comprises fresh air and which is directed obliquely into the interior of the drying tunnel 2005. One or more nozzles 2014 are combined with a diffuser 2018, in particular the diffuser is arranged adjacent to the nozzle outlet and constructed asymmetrically relative to a main flow plane through the associated nozzle. By means of an asymmetrical diffuser at the nozzles of the inlet and outlet locks 2011, 2013, it is possible to produce, at a side of the fluid stream curtain directed toward the portal 2015, 2017 of the drying tunnel 2005, a flow eddy which comprises air and which comprises, on the one hand, fluid which is introduced through a line 2019 via the nozzles 2014 and ambient air at the portals 2015, 2017. The intermediate lock 2012 has a nozzle 2009 which produces a fluid stream curtain 2020.

A modified embodiment of the installation 2001 may also be constructed without any asymmetrical diffusers at the nozzles, for instance, if reduced demands are placed upon the tightness of the locks. For example, a mechanical closing of the corresponding locks may also be provided.

The installation 2001 contains a heating device 2023 which is in the form of a device for the thermal cleaning of exhaust air and which has a line 2025 for supplying hot clean gas from the drying tunnel 2005 and a heat exchanger 2027 which is used for heating exhaust air from the drying tunnel 2005. The exhaust air which is heated in the heat exchanger 2027 from the drying tunnel 2005 can be burnt in a combustion chamber 2029 of the heating device 2023 with or without the addition of additional fuel.

The heating device 2023 supplies heat to a plurality of heat transfer devices 2031, 2033, 2035, 2037 through a hot gas line 2036 which acts as a clean gas line. The heat transfer devices 2031, 2033 and 2035 are connected to the hot gas line 2036 in a row one behind the other. The heat transfer devices 2031, 2033, 2035 are preferably constructed substantially in the same manner. The device 2037 contains an air/air heat exchanger and is connected as the last of the heat transfer devices to the hot gas line 2036. The device 2037 is used for the temperature control of the fresh air which is guided to the nozzles 2014 for producing the fluid stream curtain 2021 comprising fresh air. The devices 2031, 2033 and 2035 each contain a heat exchanger 2039 which is connected with a hot gas line 2038 to the hot gas line 2036 and are configured for agitating circulation air in the drying portions 2015*a*, 2015*b* and in the retention zone 2016. The circulating air, which is guided by a circulating air line system 2041 which communicates with the receiving regions 2015*a*, 2015*b* and 2016 and which has a circulating air recirculating channel 2041*a* for removing circulating air from the drying tunnel 2005 and a circulating air supply channel 2041*b* for the introduction of circulating air into the drying tunnel 2005, is temperature-controlled in the heat exchangers 2039.

In the installation 2001, there are devices 2043 for the supply of additional fresh air into the receiving regions of the drying tunnel 2005. The devices 2043 have lines 2045 which communicate with a receiving region in the drying tunnel 2005 and which contain a throughflow control device 2047 which is in the form of a throttle valve.

It should be noted that the throughflow control device 2047 may also be provided alternatively or additionally with a fan. Fresh air is directed via the lines 2045 into the circulating air line system 2041 of the devices 2031, 2033, 2035 if the fresh air supplied through the nozzles 2014 to the drying tunnel 2005 is not sufficient to meet the fresh air requirement inside the drying tunnel.

The installation 2001 contains a control device 2046. The control device 2046 is connected to a first device 2051 for detecting a status parameter of the drying tunnel 2005 acting as a process chamber in the installation 2001. In the device 2051, an adjustment of the throttle valves 2052, 2055 in the lines 2038 for guiding hot gas through the heat exchangers 2039 and an adjustment of the throttle valves 2047 in the lines 2045 for supplying fresh air are detected by means of potentiometers or limit switches. It is possible to establish therefrom a fluid quantity which is supplied to the drying tunnel 2005 per time unit with the devices 2031, 2033, 2035 and 2037. As a result, it is again optionally possible to establish a thermal quantity which is supplied with the fluid if the fluid temperatures are measured via temperature sensors which are associated with the lines of a circulating air line system 2041 and a line 2045.

Furthermore, the control device 2046 is connected to a second device 2053 for detecting a status parameter of the drying tunnel 2005 which acts as a process chamber in the installation 2001. The device 2053 is in the form of a bodywork counting device, with which the number of motor vehicle bodyworks 2003 moved per time unit into the drying tunnel 2005 and therefore the quantity of motor vehicle bodyworks 2003 which are arranged in the drying tunnel 2005 can be determined.

The control device 2046 is also connected to a temperature sensor 2007 for detecting the hot gas temperature $T_A$ in the hot gas line 2036. The temperature sensor 2007 is used for measuring the temperature of the hot gas which flows through the hot gas line 2036 at the outlet side of the heat transfer device 2037, with which the hot gas from the installation 2001 is released to the environment as a clean gas (clean gas over roof temperature).

The control circuit 2046 is connected to a control module 2056 for adjusting the speed of a ventilator 2057 which is arranged in the line 2025 and an additional control module 2059 for adjusting the speed of a ventilator 2061 which is used to draw fresh air into the line 2019 to the nozzles 2009 which produce a fluid stream curtain 2021 in the drying tunnel 2005.

The throughflow control devices 2047 in the devices 2043 for supplying fresh air and the speed of the ventilator 2057 are then adjusted by means of the control circuit 2046 in accordance with the value established by means of the device 2051 for the heat quantity supplied to the drying tunnel 2005 per time unit and the number established by means of the device 2053 in respect of bodyworks 2003 arranged inside the drying tunnel 2005.

So much fresh air is supplied into the line 2019 by means of the ventilator 2061 that the locks 2011, 2012 and 2013 are sealed by means of the fluid stream curtain 2021 produced with the nozzles 2009.

It should be noted that the control device 2046 can in principle also be in the form of a control circuit. It should further be noted that the fresh air supply by the heat transfer devices 2031, 2033, 2035 in the drying tunnel 2005 can also be controlled or regulated with a control device 2046, to which one or more of the subsequently set out measurement variables are supplied as process chamber operating state parameters for the installation 2001:

solvent introduction into the atmosphere in the receiving regions of the drying tunnel 2005;

total carbon content in the receiving regions of the drying tunnel 2005;

number of bodyworks arranged in the receiving regions of the drying tunnel;

temperature of the hot gas produced with the heating device 2023 in the hot gas line 2036 downstream of the device 2037 upstream of an exhaust air chimney;

temperature difference of the circulating air before and after the devices 2031, 2033 and 2035;

temperature difference of the exhaust air from the drying tunnel which is supplied to an exhaust gas cleaning installation and exhaust air which leaves the exhaust gas cleaning installation through an exhaust air chimney;

weight of a bodywork or size of a bodywork surface acted on with paint in order to conclude a solvent quantity therefrom.

It is advantageous if a plurality of measurement variables are combined in the control device 2046 as status parameters (process chamber operating state parameters). Thus, for example, a "clean gas over roof temperature" detected by means of the temperature sensor 2007 may also be detected as a primary measurement variable and an adjustment of the throttle valves 2052, 2055 for adjusting the hot gas flow in the hot gas lines 2036, 2038 (clean gas valve position) as a secondary measurement variable. The primary measurement variable is used to establish a fresh air/exhaust air volume flow and the secondary measurement variable is used for verifying, confirming and/or optionally correcting that fresh air/exhaust air volume flow.

After the fresh air/exhaust air volume flow is established by means of the "clean gas over roof temperature", for example, a verification of that flow is carried out on the basis of the secondary measurement variable. For example, the variable fresh air volume flow is kept constant or increased until the positions of all the clean gas valve positions are again below a previously fixed value, if the position of the clean gas valve positions exceeds the fixed value which is dependent on the overall system and which may be between 50% and 100% of the opening degree. Such a combination of a plurality of measurement variables can particularly ensure that a sufficient thermal quantity is contained in the drying tunnel 2005 of the installation 2001.

The installation 2001 may be operated in particular as follows:

In a first operating mode which corresponds to a charging state A of the installation 2001 of, for example, A<50% in relation to the maximum possible capacity of workpieces in the process chamber in the form of a drying tunnel, a constant fresh air volume flow is supplied via the locks 2011, 2012 and/or 2013. An additional fresh air supply via the lines 2045 into the process chamber does not necessarily have to be carried out here.

In a second operating mode which corresponds to a charging state A of the installation 2001 of, for example, 51%≤A≤90% in relation to the maximum possible capacity of workpieces in the process chamber in the form of a drying tunnel, a constant fresh air volume flow is supplied via the locks 2011, 2012 and/or 2013. At the same time, additional fresh air is introduced into the process chamber by opening throughflow control devices 2047 in the form of throttle valves in the lines 2045 via the heat exchanger devices 2031, 2033, 2035 and/or 2037.

In a third operating mode which corresponds to a charging state of the installation 2001 of, for example, 91%≤A≤100% in relation to the maximum possible capacity of workpieces in the process chamber in the form of a drying tunnel, a constant fresh air volume flow is supplied via the locks 2011, 2012 and/or 2013 and the stream of the additional fresh air which is supplied to the heat transfer devices 2013, 2033, 2035 and/or 2037 is further increased by additional opening of the throughflow control devices 2047 in relation to the second operating mode.

It should be noted that the installation 2001 can also be operated in additional operating modes in which the throughflow control devices 2047 in the lines 2045 have a different opening position in relation to the above-mentioned operating modes. In particular, in principle it is also possible to change the operating mode of the installation 2001 in a stepless manner.

It should be particularly noted that the supply of fresh air into the drying tunnel 2005 in the installation 2001 can also be carried out at locations other than those shown in FIG. 11.

In an alternative configuration of the installation 2001, for example, there may be provision for circulating air and/or fresh air to be supplied to the receiving regions 2015*a*, 2015*b*, 2016 of the drying tunnel 2005 via openings in the wall, in the ceiling and/or in the floor of the drying tunnel 2005. The supply of fresh air to the circulating air line system 2041 may also be carried out in principle in an installation 2001 described above with respect to the flow direction of the circulating air upstream or downstream of a heat exchanger 2039 in a heat transfer device 2031, 2033, 2035. It should further be noted that the supply of fresh air is possible both inside a heat transfer device 2031, 2033, 2035 and outside a heat transfer device 2031, 2033, 2035 to a circulating air recirculating channel 2041*a* or circulating air return channel of a circulating air line system 2041.

In order to adjust a defined volume flow for the fresh air, a ventilator can also be arranged in the line 2045 for fresh air. It is further possible for the fresh air to be supplied in a lock 2011, 2013, 2015 of the installation 2001 at the side of a fluid stream curtain 2021 directed into the interior of the drying tunnel 2005.

In order to explain the alternative configurations of the installation 2001 as set out above, additional installations according to the invention for drying are described below with reference to FIGS. 12 to 19.

Figure 12:
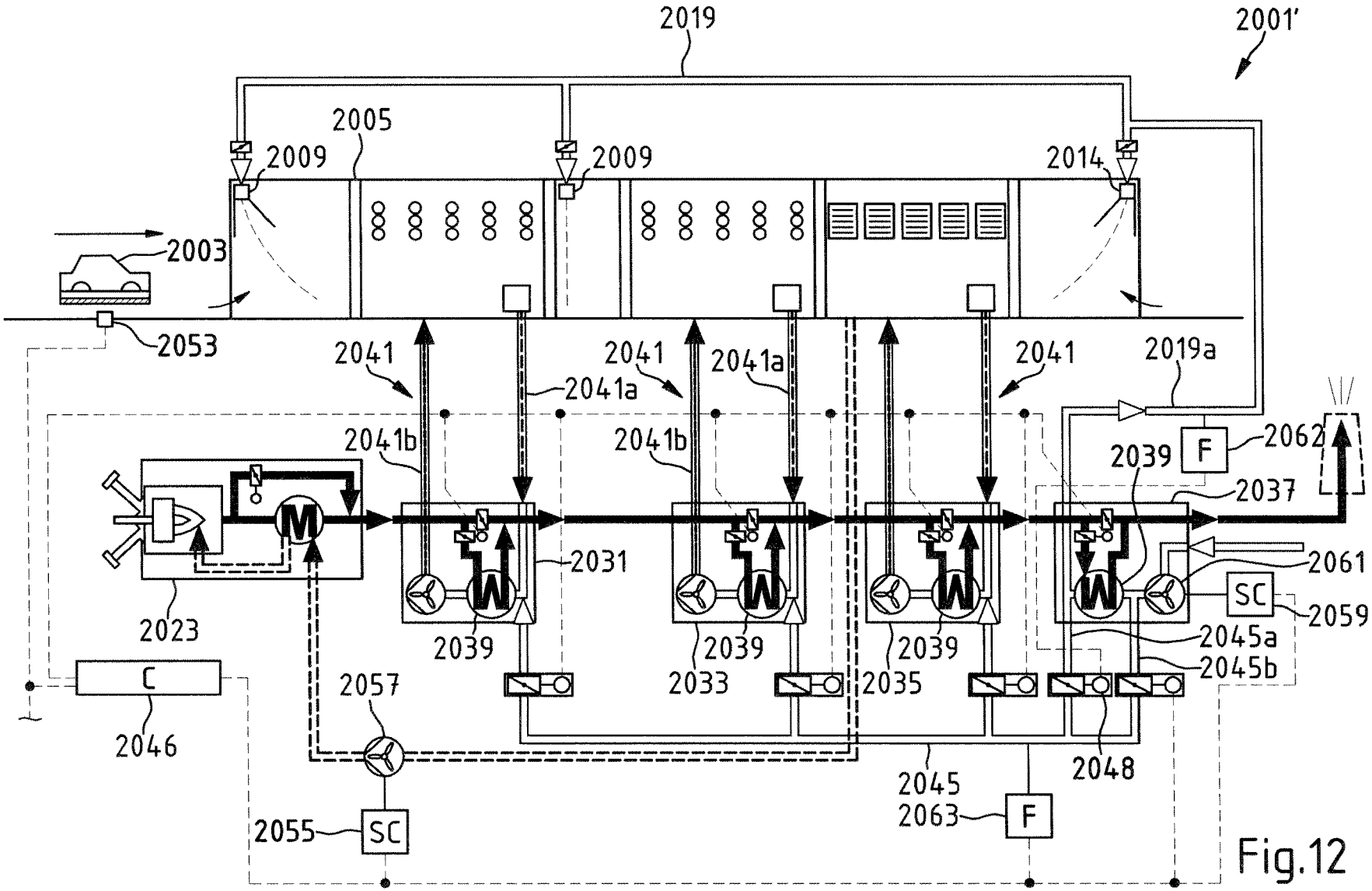
FIGS. 12 to 19 show additional alternatively constructed installations for drying workpieces.

FIG. 12 shows an additional installation 2001' which is for drying vehicle bodyworks 2003 and which corresponds in principle to the installation 2001 from FIG. 11 in terms of its construction. If the subassemblies in the installation 2001 from FIG. 11 and in the installation 2001' from FIG. 12 are identical, they have the same reference numerals in FIG. 11 and FIG. 12. In the installation 2001', the line 2045 for supplying fresh air to the circulating air line system 2041 is connected via a line branch 2045*a* and a line branch 2045*b* in the heat transfer device 2037 to the line 2019 for supplying fresh air to the nozzles 2009. As a result of the line branch 2045*a*, it is possible to supply fresh air which is drawn in by means of the ventilator 2061 into the line 2045 which has been heated in the heat exchanger 2039 of the heat transfer device 2031 with heat from the clean gas which is guided in the hot gas line 2036.

Alternatively or additionally, it is also possible to convey fresh air through the line branch 2045*b* in the heat transfer device 2037 into the line 2019 by means of the ventilator 2061 into the line 2045. In this instance, the fresh air conveyed by means of the ventilator 2061 is not then guided or only partially guided through the heat exchanger 2039 in the heat transfer device 2037.

The fresh air guided in the line 2019 is introduced in the installation 2001' in the heat transfer devices 2031, 2033 and 2035 in such a manner that it is introduced into the drying tunnel 2005 via the heat exchanger which is arranged in the heat transfer devices 2031, 2033 and 2035.

The fresh air introduced into the heat transfer devices 2031, 2033 and 2035 from the line 2045 can therefore be heated with heat from the clean gas which is guided in the hot gas line 2036.

A throughflow measurement device 2062 is arranged in the line portion 2019*a* of the installation 2001'. The throughflow measurement device 2062 controls an actuating member in a throughflow control device 2048. As a result, it can be ensured in the installation 2001' that for different speeds of the ventilator 2061 the nozzles 2009, 2014 are supplied with a constant fresh air stream for producing a fluid stream curtain 2020, 2021. A throughflow measurement device 2063 is arranged in the line 2045. The throughflow measurement device 2063 is used to establish the quantity of fresh air supplied to the line 2045 by means of the ventilator 2061.

In the installation 2001', a fresh air stream supplied into the line 2045 is adjusted by means of the throughflow control device 2048 in accordance with the number of bodyworks 2003 arranged inside the drying tunnel 2005, which number is established with the device 2053.

The throughflow measurement devices 2062, 2063 determine the quantity of fresh air supplied to the line 2019, 2045 by means of the ventilator 2061 by detecting the pressure decrease at an aperture which is arranged in the line portion with the throughflow measurement device 2062, 2063. It should be noted that the throughflow measurement device 2062, 2063 for detecting the flow of fresh air can contain, as an alternative thereto, a magnetically inductive sensor, an ultrasound measurement unit or an impeller.

Figure 13:
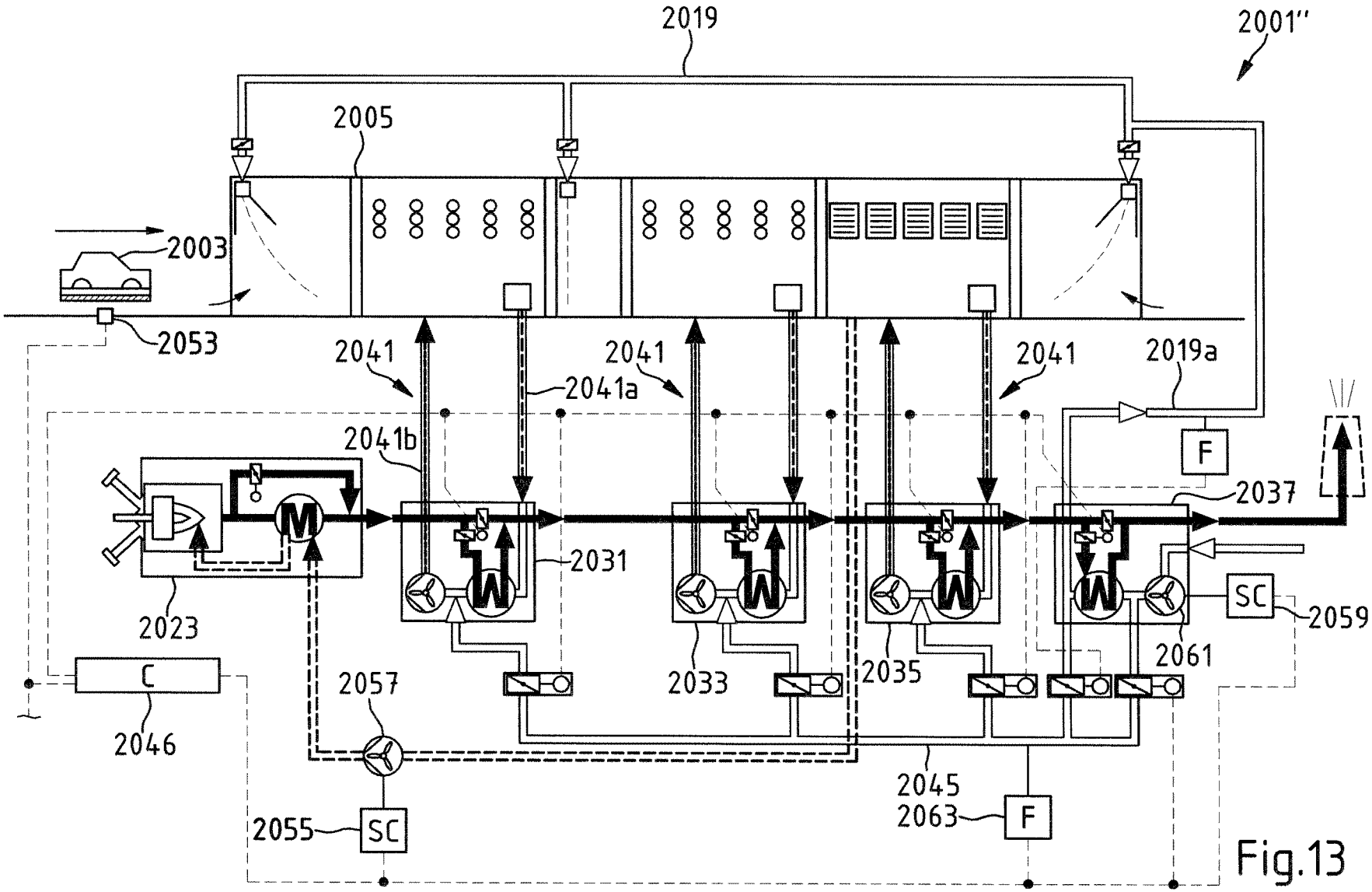

FIG. 13 shows another installation 2001" for drying, whose construction is substantially identical to the construction of the above-described installation 2001'. If the subassemblies in the installations shown in FIG. 12 and FIG. 13 are functionally identical, they have the same numerals in FIG. 12 and FIG. 13 as reference numerals.

Unlike in the installation 2001' from FIG. 12, in the installation 2001" the fresh air is supplied to the circulating air line system 2041 at the outlet side with respect to the heat exchanger 2039 through the line 2045 for supplying fresh air to the heat transfer devices 2031, 2033 and 2035. In a heat exchanger 2039 of a heat transfer device 2031, 2033, 2035, only the circulating air supplied through a supply channel 2041*a* from the drying tunnel 2005 is then heated.

Figure 14:
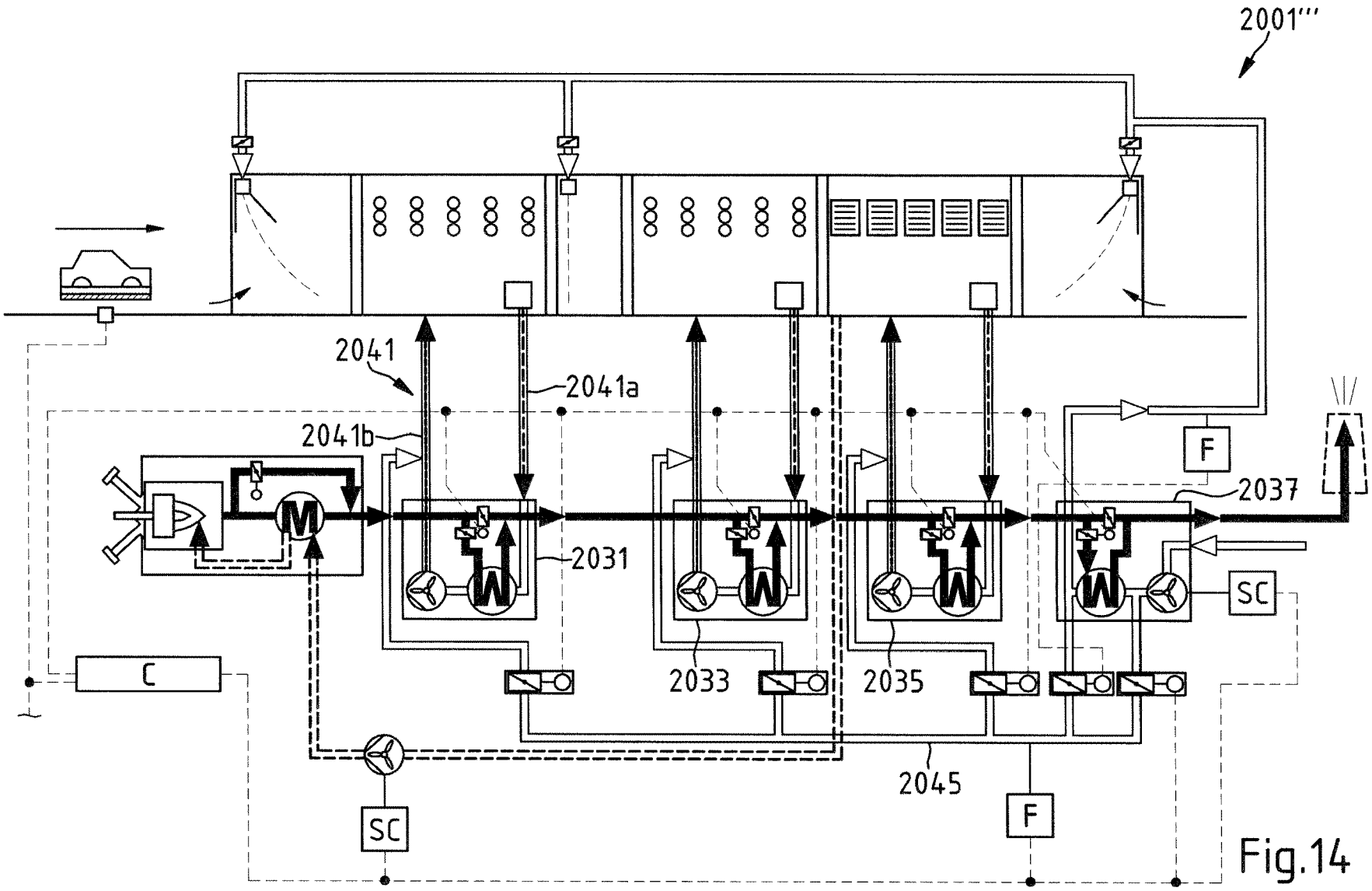
Figure 15:
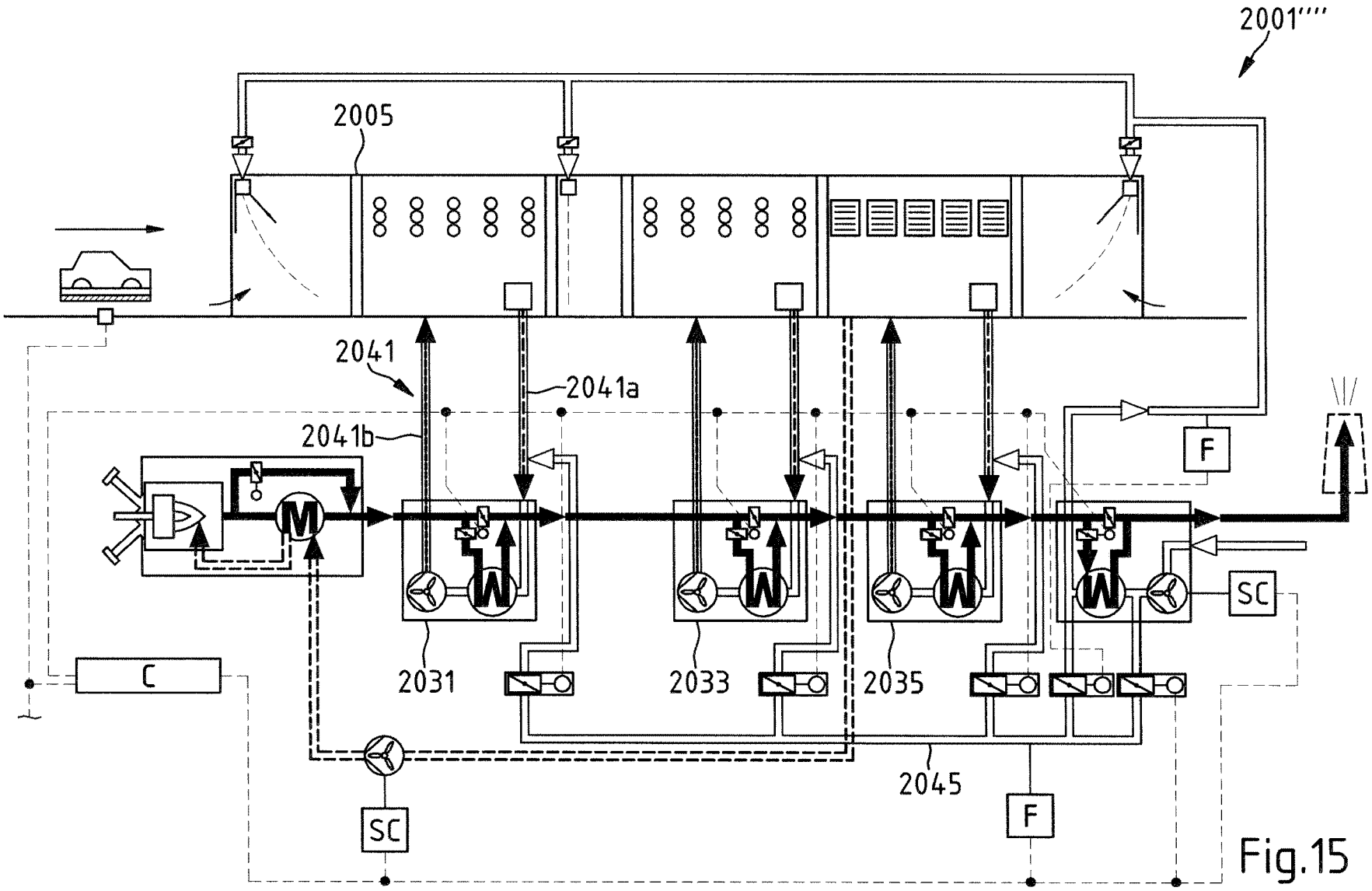

FIGS. 14 and 15 show additional installations 2001'" and 2001"" for drying whose construction corresponds to the construction of the installation described with reference to FIG. 12 and FIG. 13. Functionally identical subassemblies in those installations again have here the same reference numerals as the corresponding subassemblies of the installations from FIG. 12 and FIG. 13. In the installation 2001'", fresh air is introduced via the line 2045 outside the heat transfer devices 2031, 2033 and 2035 into the circulating air return channel 2041*b* of the line system. In the installation 2001"", the line 2045 for supplying fresh air to the drying tunnel 2005 is connected to a circulating air recirculating channel 2041*a* of the line system 2041, through which channel the circulating air from the drying tunnel 2005 is directed into a heat transfer device 2031, 2033 and 2035.

It should be noted that in a modified embodiment of the installation 2001'" from FIG. 14 or 2001"" from FIG. 15, there may also be provision for fresh air to be supplied from a line 2045 both to a circulating air recirculating channel 2041*a* and to a circulating air return channel 2041*b* of a circulating air line system 2041. If the fresh air is supplied to a circulating air return channel 2041*b*, however, it must be ensured that the relevant fresh air is warmed.

Figure 16:
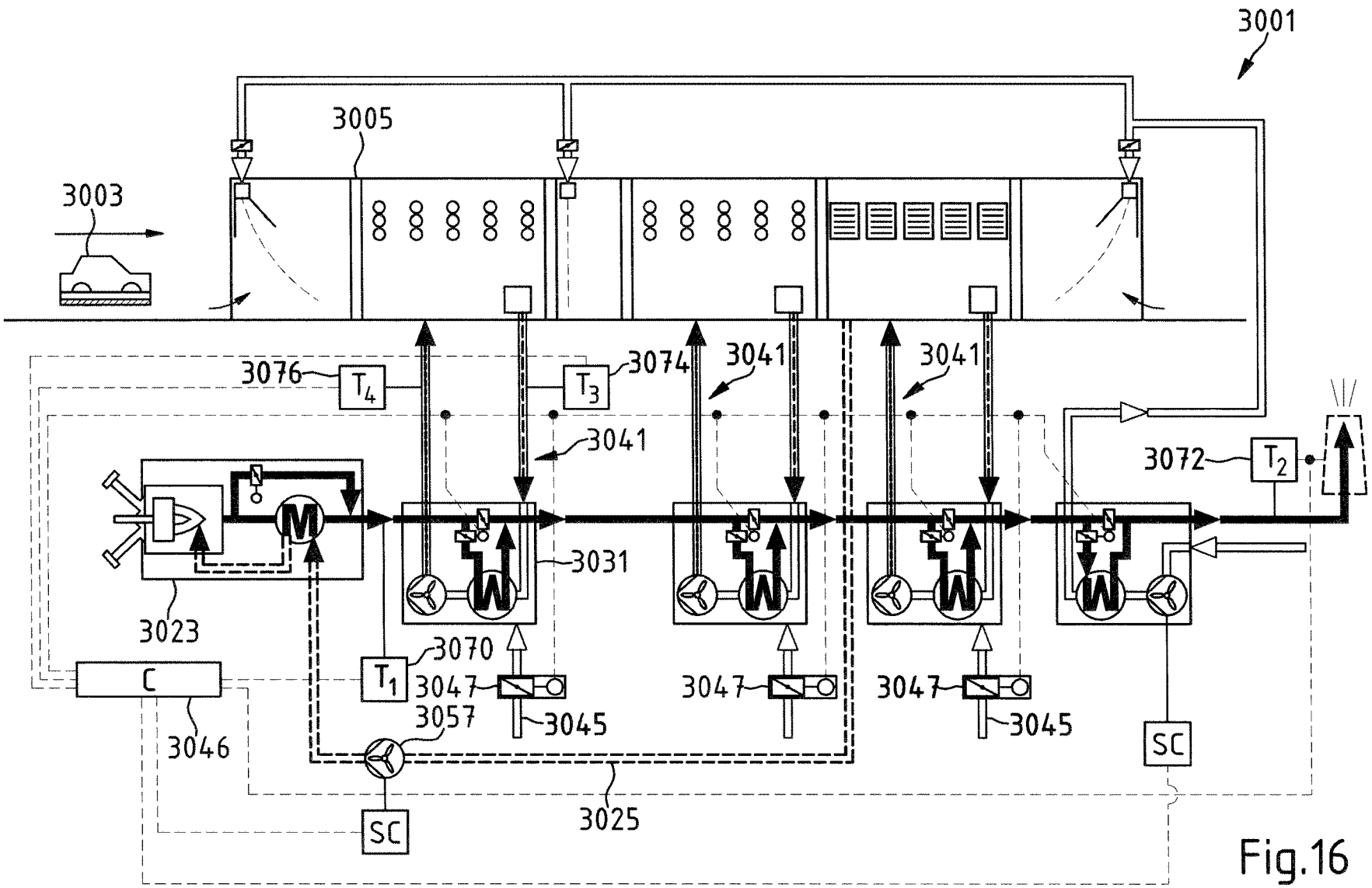

The installation 3001 shown in FIG. 16 for drying vehicle bodyworks 3003 has a plurality of temperature sensors 3070, 3072, 3074 and 3076 as a device for detecting a status parameter of a drying tunnel 3005 which acts as a process chamber. If the subassemblies in the installation 3001 functionally correspond to the subassemblies in the installation 2001 from FIG. 11, they are indicated in FIG. 12 with numerals which are increased by 1000 in relation to FIG. 11 as reference numerals.

The temperature sensors 3070, 3072, 3074 and 3076 are connected to the control device 3046. The temperature sensor 3070 is arranged in the hot gas line 3026 between the heating device 3023 and the heat transfer device 3031. The temperature sensor 3072 is located in an end portion of the hot gas line 3026, from which the clean gas which flows through the hot gas line 3026 is introduced into the ambient atmosphere. The temperature sensors 3070, 3072 are used for establishing the heat which is discharged into the drying tunnel 3005 by the clean gas flowing through the hot gas line 3026 by the difference of the temperatures measured by means of those temperature sensors $\Delta T_H = T_1 - T_2$ being established. With the temperature sensors 3074 and 3076, there is established the difference of the temperatures $\Delta T_U := T_3 - T_4$ of circulating air which flows from the drying tunnel 3005 in the circulating air recirculating channel 3041*a* and circulating air which is mixed with fresh air and which is directed through the circulating air supply channel 3041*b* into the drying tunnel 3005.

The control device 3046 controls the speed of the ventilator 3057 in the line 3025 and the adjustment of the throughflow control devices 3047 for adjusting the quantity of fresh air supplied to the line system 3041 in accordance with the temperature difference $\Delta T_H$, $\Delta T_E$ detected by means of the temperature sensors 3070, 3072, 3074 and 3076. Alternatively, the control device 3046 may also be constructed as a control circuit which controls the speed of the ventilator 3057 in the line 3025 and the adjustment of the throughflow control device 3047 on the basis of the signal of the temperature sensors 3070, 3072, 3074 and 3076.

Figure 17:
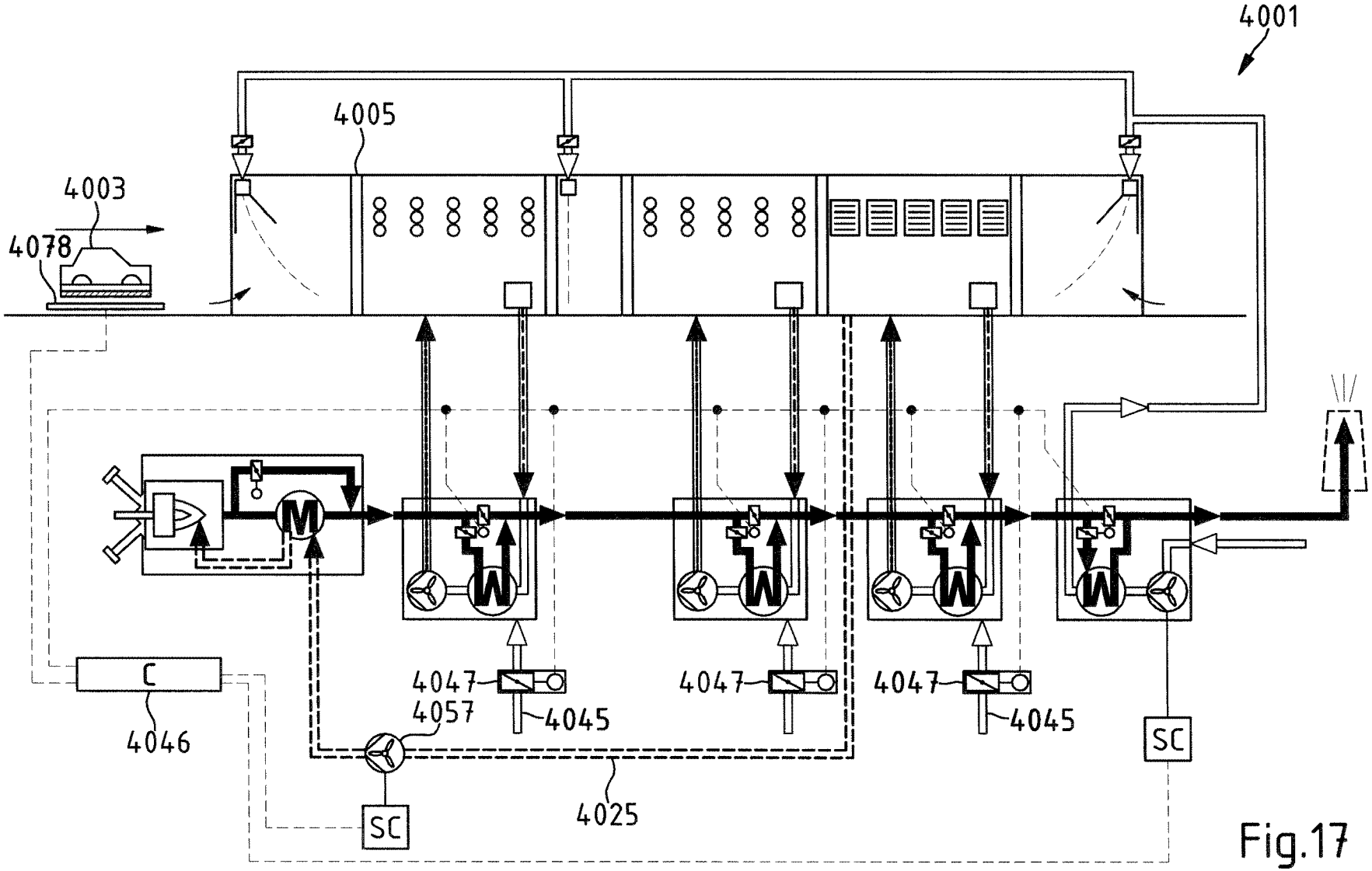

The installation 4001 shown in FIG. 17 for drying vehicle bodyworks 4003 has as a device for detecting a status parameter of a drying tunnel 4005 which acts as a process chamber a balance 4078 for establishing the mass of vehicle bodyworks 4003 supplied to the drying tunnel 4005. If the subassemblies in the installation 4001 functionally correspond to the subassemblies in the installation 2001 from FIG. 11, they are indicated in FIG. 13 with numerals which are increased by 2000 in relation to FIG. 11 as reference numerals.

In this instance, the control device 4046 controls the speed of the ventilator 4057 in the line 4025 and the adjustment of the throughflow control devices 4047 for adjusting the quantity of fresh air supplied to the line system 4041 in accordance with the mass of the vehicle bodyworks 4003 supplied to the drying tunnel 4005, which mass is detected by means of the balance 4078.

Figure 18:
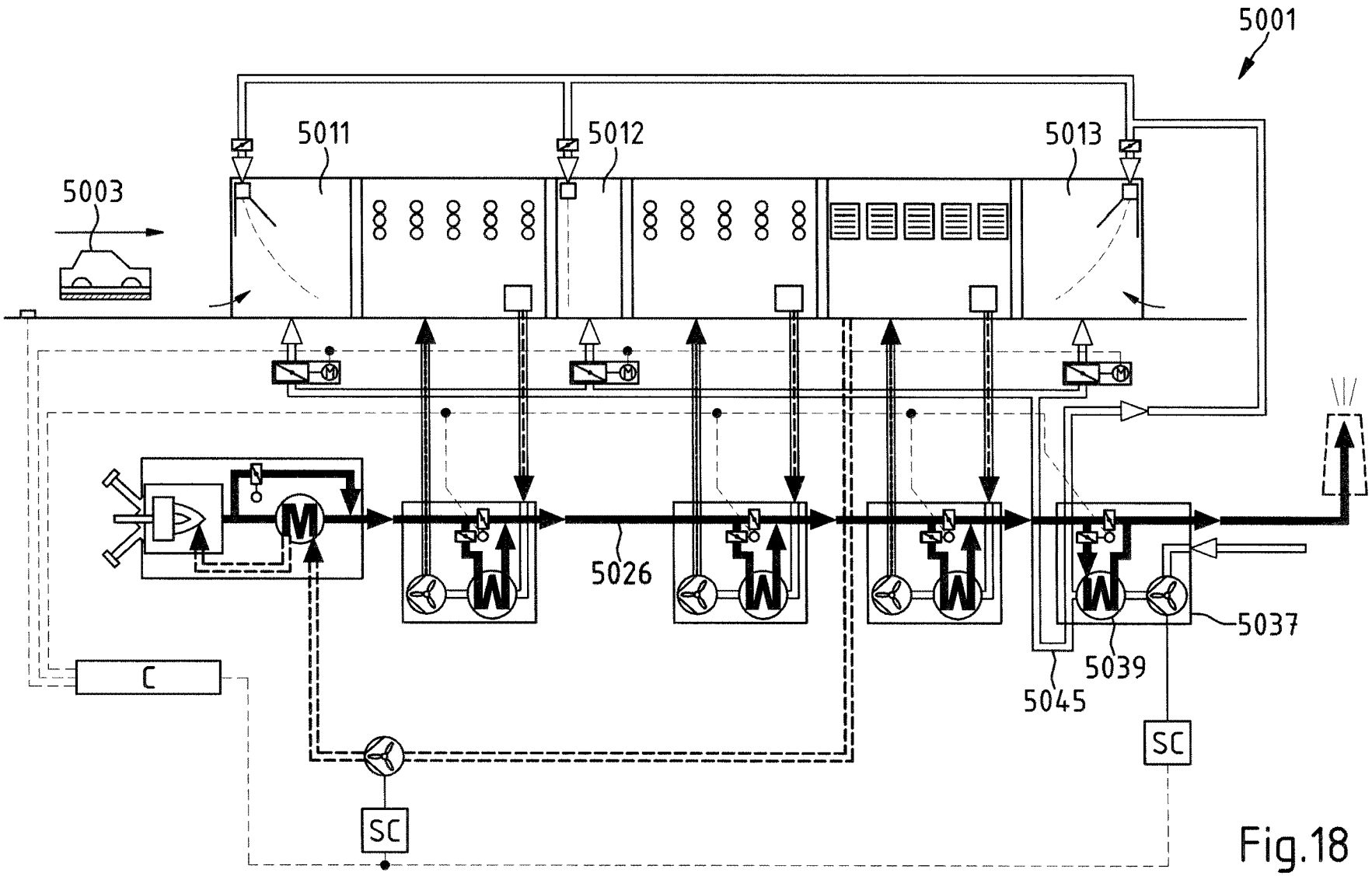

FIG. 18 shows an installation 5001 for drying vehicle bodyworks 5003. If the subassemblies in the installation 5001 functionally correspond to the subassemblies in the installation 2001 from FIG. 11, they are indicated in FIG. 17 with numerals which are increased by 3000 in relation to FIG. 11 as reference numerals. In the installation 5001, the line 5045 for the supply of fresh air in the heat transfer device 5037 receives fresh air which can be heated by means of the heat exchanger 5039 with heat from the clean gas guided in the hot gas line 5026. The fresh air from the line 5045 is introduced into the locks 5011, 5012 and 5013 of the drying tunnel in the installation 5005.

Figure 19:
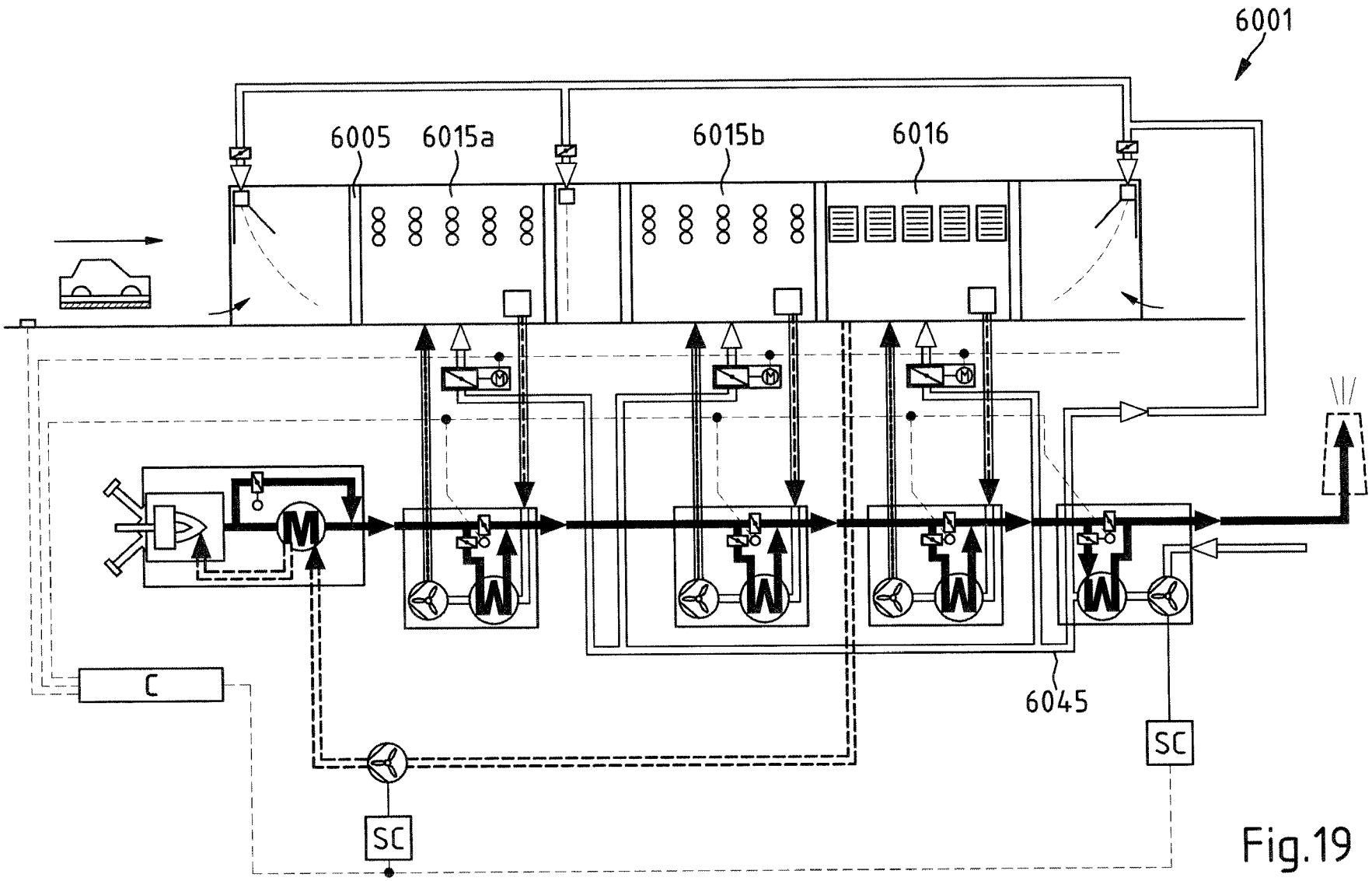

FIG. 19 shows an installation 6001 for drying vehicle bodyworks 6003. If the subassemblies in the installation 6001 functionally correspond to the subassemblies in the installation 5001 from FIG. 18, they are indicated in FIG. 19 with numerals which are increased by 1000 in relation to FIG. 18 as reference numerals. In the installation 6001, the fresh air from the line 6045 is introduced into the drying portions 6015*a*, 6015*b* and the retention zone 6016 of the drying tunnel 6005.

Additional modifications and developments of an installation according to the invention may result inter alia from a combination of different features of the above-described advantageous embodiments.

In conclusion, the following preferred features of the invention should be emphasized: According to a first aspect of the invention, a process chamber 5, 2005 has an inner space 39 having a receiving region 15, 2015*a*, 2015*b*, 2016 for workpieces 3, 2003. The process chamber 5, 2005 has a portal 12, 14, 2015, 2017 for the supply or discharge of workpieces 3, 2003. The process chamber 5, 2005 is constructed so as to have a device 17, 19, 25, 29, 33, 37, 35, 2014 for introducing gaseous fluid into the inner space 39, which device has at least one nozzle 17, 19, 2014 or aperture 803 for producing a fluid stream curtain 21, 23, 2021 between the portal 12, 14, 2015, 2017 and the receiving region 15, 2015*a*, 2015*b* for workpieces 3, 2003. The process chamber 5, 2005 has a device 74, 2043 for supplying fresh air with which fresh air can be introduced into the receiving region 15, 2015*a*, 2015*b* at a side of the fluid stream curtain 21, 23, 2021 facing away from the portal 12, 14, 2015, 2017.

According to a second aspect of the invention, the device (74, 2043) may contain for the supply of fresh air at least one line (78, 2045) which communicates with the receiving region (15, 2015*a*, 2015*b*) and which has an opening for drawing in fresh air and which has a throughflow control device (80, 2047).

According to a third aspect, the throughflow control device may in this case comprise a throttle valve (80, 2047) and/or an adjustable fan.

According to a fourth aspect of the invention, a device (70, 2031, 2033, 2035) for agitating gaseous fluid in the receiving region (15, 2015*a*, 2015*b*) by means of a circulating air line system (72, 2041) may be provided, which system communicates with the receiving region (15, 2015*a*, 2015*b*) and which is guided through a device (2031, 2033) for temperature control, in particular for heating gaseous fluid from the receiving region (15, 2015*a*, 2015*b*).

According to a fifth aspect of the invention, the device (74, 2043) for the supply of fresh air into the receiving region (15, 2015*a*, 2015*b*) may in this case contain at least one line (76, 2045) which has an opening (78) for drawing in fresh air and which is connected to the circulating air line system (72, 2041) and which comprises a throughflow control device (80).

According to a sixth aspect, the throughflow control device may in this case comprise a throttle valve (80, 2047) and/or an adjustable fan.

According to a seventh aspect of the invention, the line (76) with the opening (80) for drawing in fresh air may open into a circulating air return channel (77) in the circulating air line system (72).

According to an eighth aspect of the invention, the throughflow control device (80, 2047) may be connected to a control or regulation circuit (45, 2049) which receives the signal of a device (49, 69, 73, 2051) for detecting a status parameter of the process chamber (5, 2005) and which controls or regulates the quantity of fresh air which is introduced into the receiving region (15) via the device for supplying fresh air by means of the throughflow control device (80, 2047) in accordance with at least one detected status parameter.

According to a ninth aspect of the invention, the device (2051) is configured for detecting a status parameter of the process chamber (5, 2005) from the group set out below:

i. carbon content and/or solvent content of the atmosphere in the receiving region (2015*a*, 2015*b*, 2016);

ii. number and/or weight and/or type and/or size of the surface of workpieces (2003) which are arranged in the receiving region;

iii. number and/or weight and/or type and/or size of the surface of workpieces (2003) supplied to the receiving region per time unit;

iv. temperature of the exhaust air from the combustion chamber (2029) of a burner in a device for the temperature control of circulating air;

v. temperature difference of gaseous fluid which is removed from the receiving region (2015*a*) and which is supplied to the receiving region (2015*a*) again;

vi. temperature difference of gaseous fluid from the receiving region (2015*a*) which is supplied to a combustion chamber (2029) of a burner in a device for the temperature control of circulating air, and of exhaust air from the combustion chamber (2029) of the burner;

vii. heat quantity per time unit which is supplied to the process chamber (2005).

According to a tenth aspect of the invention, the receiving region may be subdivided into a first receiving region (2015*a*) and an additional receiving region (2015*b*) and the device (2014) for introducing gaseous fluid into the inner space produces the fluid stream curtain (2021) between the first receiving region (2015*a*) and the additional receiving region (2015*b*).

According to an eleventh aspect of the invention, the inner space (39) may be constructed so as to be of tunnel-like form and may have a floor (41) and a ceiling (6), wherein the at least one nozzle (17, 19) or aperture (803) is in the form of a slot which supplies the gaseous fluid to the inner space (39) via the ceiling (6) with a flow direction (402) which is oblique in relation to the floor (41) and the gaseous fluid which is supplied to the inner space (39) produces a flow eddy (407) which comprises air and which is at least partially mixed with introduced fluid at the side of the fluid stream curtain (21, 23), which side is directed toward the portal (12, 14).

According to a twelfth aspect of the invention, the gaseous fluid which is supplied to the inner space (39) may be fresh air.

According to a thirteenth aspect of the invention, the gaseous fluid which is introduced into the inner space (39) via the at least one nozzle (17, 19) or aperture (803) may be guided by a diffuser (16, 2116) into the inner space (39).

According to a fourteenth aspect of the invention, the guiding contour (606) may be formed on a pivotable guiding wing (605).

According to a fifteenth aspect of the invention, a wall (215, 1215) which defines with the guiding contour (211, 1211) a diffuser (16, 18) having a mixing chamber (217, 1217), in which fluid from the flow eddy (407, 1407) is mixed with air from the region of the portal (213, 1213), may be arranged at the side of the guiding contour (211, 1211), which side is directed toward the portal (213, 1213).

According to a sixteenth aspect of the invention, mixed fluid from the mixing chamber (407, 1407) is drawn into the inner space (39, 1039) by the gaseous fluid which flows through the nozzle (17, 19, 1017) or the aperture (803).

According to a seventeenth aspect of the invention, the wall (709, 809) has one or more openings (816) for the introduction of circulating air from the region of the portal (213).

According to an eighteenth aspect of the invention, an auxiliary chamber (216) which acts as a dead space for gaseous fluid is formed at a side of the guiding contour (211) directed away from the mixing chamber (217).

According to a nineteenth aspect of the invention, a guiding wing (1218) which is subjected to flow with gaseous fluid from the flow eddy (1407) and which guides the fluid back from the flow eddy (1407) into the fluid stream curtain (1401) is arranged in the mixing chamber (1217).

According to a twentieth aspect of the invention, the at least one nozzle (503) in the installation may have a device (511) for adjusting the flow quantity which is introduced through the nozzle (503) for fluid, and/or a plurality of nozzles (903, 905, 907) having a device for adjusting the flow quantity which is introduced through the nozzle for fluid may be provided in order to adjust the fluid stream curtain in different manners in different portions between the inlet portal and the receiving region for workpieces (912).

According to a twenty-first aspect of the invention, a pivotable flow barrier (1220) may be provided for controlling a fluid flow which is formed in the inner space (1039).

According to a twenty-second aspect of the invention, the device for introducing gaseous fluid may have a heating device (43, 44) for heating the gaseous fluid.

According to a twenty-third aspect of the invention, an installation configured according to one of the above aspects may be in the form of a drying and/or hardening installation and/or in the form of a painting installation.

According to a twenty-fourth aspect, the invention relates to a method for operating an installation configured according to one of the aspects specified above, wherein for producing the fluid stream curtain (21, 23, 2021) gaseous fluid which is acted on with pressure is guided through the nozzle (17, 19) or aperture (803) and wherein, in a mixing chamber (217) arranged adjacent to the nozzle (17, 19), air from the region of a portal (213) or the inner space (39) of the process chamber (5) is added to the gaseous fluid which flows out of the nozzle (17, 19).

According to a twenty-fifth aspect of the invention, the gaseous fluid which is guided through the nozzle (17, 19) may in this case be guided along a guiding contour (211) which delimits the mixing chamber (217) and which separates in particular the mixing chamber (217) from an auxiliary chamber (216) which is arranged adjacent thereto and which acts as a dead space for gaseous fluid.

According to a twenty-sixth aspect of the invention, in the abovementioned method a stream of gaseous fluid guided through the nozzle (17, 19) or aperture (803) for producing a fluid stream curtain (21, 23) between the portal (12, 14) and the receiving region (15) for workpieces (3) may be throttled or interrupted and/or the direction of the fluid stream curtain (21, 23) may be changed if a workpiece (3) is moved through the portal (12, 14).

According to a twenty-seventh aspect of the invention, in the abovementioned method the fluid stream curtain (21, 23, 2021) may be produced with a quantity of fresh air which remains constant in terms of the mean time over a time period and which is guided through the nozzle (17, 19) or the aperture (803), and wherein a variable quantity of fresh air, which is controlled or regulated in accordance with a process chamber operating state parameter from the group set out below, is supplied with the device (74, 2043) for supplying fresh air to the inner space (39) during the time period:

i. carbon content and/or solvent content of the atmosphere in the receiving region (2015*a*, 2015*b*, 2016);

ii. number and/or weight of workpieces (2003) which are arranged in the receiving region;

iii. number and/or weight of workpieces (2003) supplied to the receiving region per time unit;

iv. temperature of the exhaust air from the combustion chamber (2029) of a burner in a device for the temperature control of circulating air;

v. temperature difference of gaseous fluid which is removed from the receiving region (2015*a*) and which is supplied to the receiving region (2015*a*) again;

vi. temperature difference of gaseous fluid from the receiving region (2015*a*) which is supplied to a combustion chamber (2029) of a burner in a device for the temperature control of circulating air and of exhaust air from the combustion chamber (2029) of the burner;

vii. heat quantity per time unit which is supplied to the process chamber (2005).

It is understood that the foregoing description is that of the preferred embodiments of the invention and that various changes and modifications may be made thereto without departing from the spirit and scope of the invention as defined in the appended claims.

LIST OF REFERENCE NUMERALS

1 Installation

3 Vehicle bodywork

5 Drying tunnel, process chamber
6 Ceiling
7 Skid
9 Conveying device
10 Drive
11 Inlet lock
12 Inlet portal
13 Outlet lock
14 Outlet portal
15 Drying portion, drying zone
16, 18 Diffuser
17, 19 Nozzle
17, 19, 25, 29, 33, 37, 35 Device
21, 23 Fluid stream curtain
25, 27 Fresh air
29, 31 Chamber
33, 35 Opening
37 Horizontal
39 Inner space
41 Floor
42 Ambient air
43, 44 Heating device
45, 47 Control device
49, 51 Sensor
61 Ventilator
74, 74' Device
63 Heating device
69, 71 Temperature sensor
70 Device
72 Circulating air line system
73 Solvent sensor
74 Device
75 Feed channel
76, 76' Line
77 Return channel
78, 78' Opening
80, 80' Throughflow control device
201 Pipeline
202 Main flow plane
203 Chamber
204 Plane
205 Air filter
206 Housing plate
207 Guiding plate
208 Rotation axis
209 Opening
210 Fluid stream
211 Guiding contour, contour, guiding plate
213 Inlet portal
215 Front wall, front plate
216 Auxiliary chamber
217 Mixing chamber
219 Fluid
401 Fluid stream curtain, fluid curtain
402 Arrow
403 Leg
406 Arrow
407 Flow eddy
408 Arrow
409 Center
501 Lock, inlet lock
503 Nozzle
505 Nozzle opening
507 Nozzle opening
509 Cover
507, 509 Nozzle openings
511 Control valve
601 Lock
603 Nozzle
605 Guiding plate
606 Guide contour
607 Opening, nozzle
608 Ceiling
609 Front wall
611 The interior
612 Ridge element
613 Mixing chamber
615 Rotary joint
616 Horizontal
617 Double-headed arrow
619 Opening
701 Lock
703 Nozzle
704 Flow channel
705 Guiding plate
706 Guide contour
708 Ceiling
709 Front wall
711 The interior
713 Mixing chamber
721 Region
801 Lock
803 Aperture
804 Opening
805 Guiding plate
806 Guide curtain
808 Ceiling
809 Front wall
812 Ridge element
816 Recess
821 Region
900 Drying tunnels
901 Lock, outlet lock
903, 905, 907 Nozzle
909 Fresh air flow
910 Ceiling
911, 913, 915 Channel
917 Fluid stream curtain
1006 Ceiling
1009 Opening
1011 Lock, inlet lock
1017 Nozzle
1039 Inner space
1041 Floor
1209 Opening
1210 Diffuser
1211 Guiding plate
1213 Portal, inlet portal
1215 Ridge wall
1216 Auxiliary chamber
1217 Mixing chamber
1218 Flow guiding element, flow wing
1220 Silhouette wall, arrow
1222 Axis
1224 Arrow
1401 Fluid stream curtain
1402 Arrow
1403 Leg
1406 Arrow
1407 Flow eddy
1408 Arrow
1409 Center, rotation center
2001, 2001', 2001", 2001'", 2001"" Installation
2003 Vehicle bodywork, workpiece

2005 Drying tunnel, process chamber
2007 Temperature sensor
2009 Nozzle
2011, 2012, 2013, 2015 Lock
2014 Nozzle
2015*a*, 2015*b* Drying portion, receiving region
2015, 2017 Portal
2016 Retention zone
2018 Diffuser
2019 Line
2019*a* Line portion
2020 Fluid stream curtain
2021 Fluid stream curtain
2023 Heating device
2025 Line
2027 Heat exchanger
2029 Combustion chamber
2031, 2033, 2035 Heat transfer device
2036, 2038 Hot gas line
2037 Heat transfer device
2039 Heat exchanger
2041 Circulating air line system
2041*a* Circulating air recirculating channel
2041*b* Circulating air supply channel
2043 Device
2045 Line
2045*a*, 2045*b* Line branch
2046 Control device
2047, 2048 Throughflow control device
2049 Control circuit
2051, 2053 Device
2052, 2055 Throttle valve
2056, 2059 Control module
2057, 2061 Ventilator
2062, 2063 Throughflow measurement device
3001 Installation
3003 Vehicle bodywork, workpiece
3005 Drying tunnel, process chamber
3023 Heating device
3025, 3045 Line
3026 Hot gas line
3031 Heat transfer device
3041 Line system
3041*a* Circulating air recirculating channel
3041*b* Circulating air supply channel
3046 Control device
3047 Throttle valves
3057 Ventilator
3070, 3072, 3074, 3076 Temperature sensor
4001 Installation
4003 Vehicle bodywork, workpiece
4005 Drying tunnel, process chamber
4025, 4045 Line
4041 Line system
4046 Control device
4047 Throttle valve
4057 Ventilator
4078 Balance
5001 Installation
5003 Vehicle bodywork, workpiece
5011, 5012, 5013 Lock
5036 Hot gas line
5037 Heat transfer device
5039 Heat exchanger
5041 Line system
5041*a* Circulating air recirculating channel
5045 Line
6001 Installation
6005 Drying tunnel
6015*a*, 6015*b* Drying portion
6045 Line

What is claimed is:

1. A process chamber comprising:
an inner space defining a tunnel-shaped receiving region for workpieces;
said receiving region having a ceiling and a floor;
a portal for supplying or discharging workpieces;
a blowing arrangement for blowing a gaseous fluid into said inner space;
said blowing arrangement including at least one slot-shaped nozzle or aperture for generating a fluid flow curtain between said portal and said receiving region for workpieces;
a pivotable guide plate having a guide contour formed thereon; and,
said slot-shaped nozzle or aperture being arranged to direct said gaseous fluid via said ceiling into said inner space along said guide contour in a flow direction inclined with respect to said floor.

2. The process chamber of claim 1, further comprising:
said guide contour having a side facing toward said portal;
an inlet lock or an outlet lock having a wall arranged at said side of said guide contour; and,
said guide contour and said wall conjointly delimiting a mixing chamber wherein air present in the region of said portal is entrained by said gaseous fluid supplied via said slot-like nozzle or said aperture and drawn therewith into said interior space.

3. The process chamber of claim 2, wherein said mixing chamber is disposed above said portal and set back upwardly with reference to said ceiling.

4. The process chamber of claim 2, wherein said wall has one or more passthrough openings formed therein to permit a pass through of circulating air from the region of said portal.

5. The process chamber of claim 2, wherein said guide contour has a side facing away from said mixing chamber; and, wherein said process chamber further comprises an auxiliary chamber located at said side facing away from said mixing chamber and functioning as a dead space.

6. The process chamber of claim 1, wherein at least one of said slot-shaped nozzles or apertures includes a device for adjusting the flow quantity passing therethrough to adjust said fluid flow curtain between said portal for receiving workpieces and said receiving region for workpieces differently in various sections.

7. The process chamber of claim 1, wherein several of said at least one nozzle include a device for adjusting the flow quantity passing therethrough to adjust said fluid flow curtain between said portal for receiving workpieces and said receiving region for workpieces differently in various sections.

8. The process chamber of claim 1, further comprising a pivotable flow barrier for controlling a fluid flow formed in said inner space.

9. The process chamber of claim 1, wherein said blowing arrangement includes a heating device for heating said gaseous fluid.

10. An installation for performing operations including at least one of hardening, drying and lacquering, the installation comprising a process chamber including:
an inner space defining a tunnel-shaped receiving region for workpieces;
said receiving region having a ceiling and a floor;

a portal for supplying or discharging workpieces;

a blowing arrangement for blowing a gaseous fluid into said inner space;

said blowing arrangement including at least one slot-shaped nozzle or aperture for generating a fluid flow curtain between said portal and said receiving region for workpieces;

a pivotable guide plate having a guide contour formed thereon; and, said slot-shaped nozzle or aperture being arranged to direct said gaseous fluid via said ceiling into said inner space along said guide contour in a flow direction inclined with respect to said floor.

11. A method for operating a process chamber which includes: an inner space defining a tunnel-shaped receiving region for workpieces; the receiving region having a ceiling and a floor; a portal for supplying or discharging workpieces; a blowing arrangement for blowing a gaseous fluid into the inner space; the blowing arrangement including at least one slot-shaped nozzle or aperture for generating a fluid flow curtain from the gaseous fluid between the portal and the receiving region for workpieces; the method comprising the steps of:

supplying gaseous fluid into the inner space in a flow direction inclined with respect to the floor and directed away from the portal and toward the floor; and, changing the flow direction of the fluid flow curtain when one of the workpieces is moved into the inner space.

12. The method of claim 11, wherein the process chamber further includes a guide contour and the method further comprises moving the gaseous fluid along the guide contour into the inner space.

13. The method of claim 11, wherein the process chamber further includes a pivotable guide contour and the method further comprises pivoting the guide contour for adjusting the direction of the fluid flow curtain.

14. The method of claim 13, wherein said fluid flow curtain has a side facing toward the portal; and, a flow eddy is generated on said side of said flow curtain and is made up of air mixed at least partially with the blown-in gaseous fluid, the air extending from the floor up to the ceiling in an input lock or an output lock of the process chamber.

15. The method of claim 14, further comprising:

guiding the gaseous fluid blown into the inner space via the at least one slot-shaped nozzle or aperture along the guide contour into the inner space; and, providing a wall on the side of the guide contour facing toward the portal with the wall and the guide contour conjointly delimiting a mixing chamber wherein fluid from a flow eddy is mixed with air from the region of the portal and drawn into the inner space by the gaseous fluid flowing through the at least one nozzle or aperture.

16. The method of claim 11, comprising the further step of throttling or interrupting the flow of gaseous fluid for generating the fluid flow curtain between the portal and the receiving region for workpieces when a workpiece is passed through the portal.

17. An installation comprising:

a process chamber having a tunnel-shaped inner space defining a receiving region for workpieces;

said inner space having a floor and a ceiling;

said process chamber further including a portal for supplying or discharging workpieces;

a blowing arrangement for blowing a gaseous fluid into said inner space;

said blowing arrangement including at least one nozzle or aperture for generating a fluid flow curtain between said portal and receiving region for workpieces;

said fluid flow curtain having a side facing away from said portal;

a device for supplying fresh air and being configured to introduce the fresh air at said side of said fluid flow curtain into said receiving region;

a pivotable guide contour projecting into said inner space;

said at least one nozzle or aperture having a slotted form which supplies said gaseous fluid via said ceiling into said inner space with a flow direction inclined with reference to said floor; and, said gaseous fluid being guided into said inner space on said guide contour.

18. The installation of claim 17, further comprising a pivotable guide wing; and, said guide contour being formed on said guide wing.

19. The installation of claim 18, wherein said fluid flow curtain has a side directed toward said portal; and, said gaseous fluid supplied to said inner space generates a flow eddy at said side of said fluid flow curtain which is at least partially mixed with blown-in fluid.

20. The installation of claim 19, further comprising a diffuser; and, said gaseous fluid blown into said inner space via said at least one nozzle or aperture is conducted into said inner space via said diffuser.

21. The installation of claim 20, wherein said guide contour has a side facing said portal; and, wherein said installation further comprises a wall arranged on said side of said guide contour; and, said wall and said guide contour conjointly define said diffuser together with a mixing chamber wherein fluid from said flow eddy is mixed with air from the region of said portal.

22. The installation of claim 21, wherein mixed fluid from said mixing chamber is drawn into said inner space by the gaseous fluid flowing through said nozzle or aperture.

23. The installation of claim 22, wherein said wall has one or several openings for passing circulating air therethrough from the region of said portal.

24. The installation of claim 23, wherein said guide contour has a side facing away from said mixing chamber; and, wherein said installation further comprises an auxilliary chamber configured on said side of said guide contour facing away from said mixing chamber with said auxiliary chamber functioning as a dead space for gaseous fluid.

25. The installation of claim 24, further comprising a flow guiding element mounted in said mixing chamber which is flowed over with gaseous fluid from said flow eddy and which conducts the fluid from said flow eddy into said fluid flow curtain.

26. The installation of claim 17, wherein said installation is configured to perform operations including at least one of hardening, drying and lacquering.

27. A method of operating an installation which includes: a process chamber having a tunnel-shaped inner space defining a receiving region for workpieces; said inner space having a floor and a ceiling; said process chamber further including a portal for supplying or discharging workpieces; a blowing arrangement for blowing a gaseous fluid into said inner space; said blowing arrangement including at least one nozzle or aperture for generating a fluid flow curtain between said portal and receiving region for workpieces; said fluid flow curtain having a side facing away from said portal; a device for supplying fresh air and being configured to introduce the fresh air at said side of said fluid flow curtain into said receiving region; a pivotable guide contour projecting into said inner space; said at least one nozzle or aperture having a slotted form which supplies said gaseous fluid via said ceiling into said inner space with a flow direction inclined with reference to said floor; said gaseous fluid being guided into said inner space on said guide contour; and, a mixing chamber arranged next to said at least one nozzle or aperture; the method comprising the steps of:

conducting gaseous fluid under pressure through the at least one nozzle or aperture for generating the fluid flow curtain; and, in the mixing chamber, admixing air from the region of said portal or from the inner space of the process chamber to the gaseous fluid flowing from the nozzle.

28. The method of claim 27, wherein:

the guide contour delimits the mixing chamber and separates the mixing chamber from an auxiliary chamber functioning as a dead space for gaseous fluid and arranged next to the guide contour; and, wherein the method further comprises guiding the gaseous fluid conducted through the at least one nozzle on the guide contour.

29. The method of claim 27, further comprising:

throttling or interrupting a flow of gaseous fluid conducted through the nozzle or aperture to generate a fluid flow curtain between the portal and the receiving region for workpieces.

30. The method of claim 27, further comprising:

changing the direction of the fluid flow curtain when a workpiece is moved through the portal.

31. The method of claim 27, wherein said installation further includes a device for conducting fresh air and an arrangement for controlling the temperature of circulating air, the arrangement including a heating device for thermally cleaning exhaust air from the tunnel-shaped inner space and the heating device including a combustion chamber, the method further comprising:

generating the fluid flow curtain with a time averaged fresh air quantity remaining constant over a time span, the fresh air quantity being conducted through the nozzle or aperture;

in said time span, conducting a variable fresh air quantity into the inner space with the device for conducting the fresh air, the variable fresh air quantity being open-loop or closed loop controlled in dependence upon a process chamber operating state parameter selected from:

(a) carbon and/or solvent content of the atmosphere in the receiving region;

(b) number and/or weight workpieces in the receiving region;

(c) number and/or weight of workpieces supplied per unit of time to the receiving region;

(d) temperature of the exhaust air from the combustion chamber of the heating device in the arrangement for controlling the temperature of the circulating air;

(e) temperature difference of gaseous fluid which is drawn from the receiving region and which is supplied to the receiving region again;

(f) temperature difference of gaseous fluid from the receiving region, which is supplied to the combustion chamber of the heating device of the arrangement for controlling the temperature of the circulating air, and of exhaust air from the combustion chamber of the heating device; and, (g) heat quantity per time unit which is supplied to the process chamber.

* * * * *